US008077378B1

(12) United States Patent
Bass et al.

(10) Patent No.: US 8,077,378 B1
(45) Date of Patent: Dec. 13, 2011

(54) CALIBRATION SYSTEM AND METHOD FOR LIGHT MODULATION DEVICE

(75) Inventors: Michael Wayne Bass, Sandy, UT (US); Dennis F. Elkins, Draper, UT (US); Bret D. Winkler, South Jordan, UT (US)

(73) Assignee: Evans & Sutherland Computer Corporation, Salt Lake City, UT (US)

( * ) Notice: Subject to any disclaimer, the term of this patent is extended or adjusted under 35 U.S.C. 154(b) by 0 days.

(21) Appl. No.: 12/617,649

(22) Filed: Nov. 12, 2009

Related U.S. Application Data

(60) Provisional application No. 61/113,977, filed on Nov. 12, 2008.

(51) Int. Cl.
*G02B 26/00* (2006.01)
*G02B 26/10* (2006.01)

(52) U.S. Cl. ..... 359/291; 359/223.1; 359/237

(58) Field of Classification Search ..... 359/290–291, 359/223–225, 245, 260–263, 298, 301–303, 359/317–318, 237, 242, 295, 230–231, 238, 359/240, 247, 267, 649
See application file for complete search history.

(56) References Cited

U.S. PATENT DOCUMENTS

| | | | |
|---|---|---|---|
| 449,435 | A | 3/1891 | Brotz |
| 1,525,550 | A | 2/1925 | Jenkins |
| 1,548,262 | A | 8/1925 | Freedman |
| 1,702,195 | A | 2/1929 | Centeno |
| 1,814,701 | A | 7/1931 | Ives |
| 2,415,226 | A | 2/1947 | Sziklai |
| 2,688,048 | A | 8/1954 | Rose |
| 2,764,628 | A | 9/1956 | Bambara |
| 2,783,406 | A | 2/1957 | Vanderhooft |
| 2,991,690 | A | 7/1961 | Grey et al. |
| 3,201,797 | A | 8/1965 | Roth |
| 3,345,462 | A | 10/1967 | Good et al. |
| 3,370,505 | A | 2/1968 | Bryan |
| 3,418,459 | A | 12/1968 | Purdy et al. |
| 3,422,419 | A | 1/1969 | Mathews et al. |
| 3,485,944 | A | 12/1969 | Stephens, Jr. |
| 3,534,338 | A | 10/1970 | Christensen et al. |
| 3,553,364 | A | 1/1971 | Lee |
| 3,576,394 | A | 4/1971 | Lee |
| 3,577,031 | A | 5/1971 | Welsh et al. |

(Continued)

FOREIGN PATENT DOCUMENTS

DE 2 325 028 12/1974

(Continued)

OTHER PUBLICATIONS

Abrash, "The Quake Graphics Engine," CGDC Quake Talk taken from Computer Game Developers Conference on Apr. 2, 1996. http://gamers.org/dEngine/quake/papers/mikeab-cgdc.html.

(Continued)

*Primary Examiner* — Dawayne Pinkney
(74) *Attorney, Agent, or Firm* — Clayton, Howarth & Cannon, P.C.

(57) ABSTRACT

A calibration method for a grating light modulator includes calibrating light reflective ribbons on the modulator on a pixel-by-pixel basis. The method further includes performing a dark-state calibration and a bright-state calibration for each pixel. Once completed, the results of the dark-state calibration and the bright-state calibration may be combined to ensure a smooth transition between a dark state and a bright state for each pixel.

34 Claims, 10 Drawing Sheets

U.S. PATENT DOCUMENTS

| | | | |
|---|---|---|---|
| 3,600,798 | A | 8/1971 | Lee |
| 3,602,702 | A | 8/1971 | Warnock |
| 3,605,083 | A | 9/1971 | Kramer |
| 3,633,999 | A | 1/1972 | Buckles |
| 3,656,837 | A | 4/1972 | Sandbank |
| 3,659,920 | A | 5/1972 | McGlasson |
| 3,668,622 | A | 6/1972 | Gannett et al. |
| 3,688,298 | A | 8/1972 | Miller et al. |
| 3,709,581 | A | 1/1973 | McGlasson |
| 3,711,826 | A | 1/1973 | La Russa |
| 3,734,602 | A | 5/1973 | Deck |
| 3,734,605 | A | 5/1973 | Yevick |
| 3,736,526 | A | 5/1973 | Simmons |
| 3,737,573 | A | 6/1973 | Kessler |
| 3,746,911 | A | 7/1973 | Nathanson et al. |
| 3,757,161 | A | 9/1973 | Kline |
| 3,760,222 | A | 9/1973 | Smith |
| 3,764,719 | A | 10/1973 | Dell |
| 3,775,760 | A | 11/1973 | Strathman |
| 3,781,465 | A | 12/1973 | Ernstoff et al. |
| 3,783,184 | A | 1/1974 | Ernstoff et al. |
| 3,785,715 | A | 1/1974 | Mecklenborg |
| 3,802,769 | A | 4/1974 | Rotz et al. |
| 3,816,726 | A | 6/1974 | Sutherland et al. |
| 3,818,129 | A | 6/1974 | Yamamoto |
| 3,831,106 | A | 8/1974 | Ward |
| 3,846,826 | A | 11/1974 | Mueller |
| 3,862,360 | A | 1/1975 | Dill et al. |
| 3,886,310 | A | 5/1975 | Guldberg et al. |
| 3,889,107 | A | 6/1975 | Sutherland |
| 3,891,889 | A | 6/1975 | Fazio |
| 3,896,338 | A | 7/1975 | Nathanson et al. |
| 3,899,662 | A | 8/1975 | Kreeger et al. |
| 3,915,548 | A | 10/1975 | Opittek et al. |
| 3,920,495 | A | 11/1975 | Roberts |
| 3,922,585 | A | 11/1975 | Andrews |
| 3,934,173 | A | 1/1976 | Korver |
| 3,935,499 | A | 1/1976 | Oess |
| 3,940,204 | A | 2/1976 | Withrington |
| 3,943,281 | A | 3/1976 | Keller et al. |
| 3,947,105 | A | 3/1976 | Smith |
| 3,969,611 | A | 7/1976 | Fonteneau |
| 3,983,452 | A | 9/1976 | Bazin |
| 3,991,416 | A | 11/1976 | Byles et al. |
| 4,001,663 | A | 1/1977 | Bray |
| 4,009,939 | A | 3/1977 | Okano |
| 4,016,658 | A | 4/1977 | Porter et al. |
| 4,017,158 | A | 4/1977 | Booth |
| 4,017,985 | A | 4/1977 | Heartz |
| 4,021,841 | A | 5/1977 | Weinger |
| 4,027,403 | A | 6/1977 | Marsh et al. |
| 4,028,725 | A | 6/1977 | Lewis |
| 4,048,653 | A | 9/1977 | Spooner |
| 4,067,129 | A | 1/1978 | Abramson et al. |
| 4,077,138 | A | 3/1978 | Foerst |
| 4,093,346 | A | 6/1978 | Nishino et al. |
| 4,093,347 | A | 6/1978 | La Russa |
| 4,100,571 | A | 7/1978 | Dykes et al. |
| 4,119,956 | A | 10/1978 | Murray |
| 4,120,028 | A | 10/1978 | Membrino et al. |
| 4,138,726 | A | 2/1979 | Girault et al. |
| 4,139,257 | A | 2/1979 | Matsumoto |
| 4,139,799 | A | 2/1979 | Kureha et al. |
| 4,149,184 | A | 4/1979 | Giddings et al. |
| 4,152,766 | A | 5/1979 | Osofsky et al. |
| 4,163,570 | A | 8/1979 | Greenaway |
| 4,170,400 | A | 10/1979 | Bach et al. |
| 4,177,579 | A | 12/1979 | Peters et al. |
| 4,184,700 | A | 1/1980 | Greenaway |
| 4,195,911 | A | 4/1980 | Bougon et al. |
| 4,197,559 | A | 4/1980 | Gramling |
| 4,200,866 | A | 4/1980 | Strathman |
| 4,203,051 | A | 5/1980 | Hallett et al. |
| 4,211,918 | A | 7/1980 | Nyfeler et al. |
| 4,222,106 | A | 9/1980 | Hess et al. |
| 4,223,050 | A | 9/1980 | Nyfeler et al. |
| 4,229,732 | A | 10/1980 | Hartstein et al. |
| 4,234,891 | A | 11/1980 | Beck et al. |
| 4,241,519 | A | 12/1980 | Gilson et al. |
| 4,250,217 | A | 2/1981 | Greenaway |
| 4,250,393 | A | 2/1981 | Greenaway |
| 4,289,371 | A | 9/1981 | Kramer |
| 4,297,723 | A | 10/1981 | Whitby |
| 4,303,394 | A | 12/1981 | Berke et al. |
| 4,305,057 | A | 12/1981 | Rolston |
| 4,318,173 | A | 3/1982 | Freedman et al. |
| 4,333,144 | A | 6/1982 | Whiteside et al. |
| 4,335,402 | A | 6/1982 | Holmes |
| 4,335,933 | A | 6/1982 | Palmer |
| 4,338,661 | A | 7/1982 | Tredennick et al. |
| 4,340,878 | A | 7/1982 | Spooner et al. |
| 4,342,083 | A | 7/1982 | Freedman et al. |
| 4,343,037 | A | 8/1982 | Bolton |
| 4,343,532 | A | 8/1982 | Palmer |
| 4,345,817 | A | 8/1982 | Gwynn |
| 4,347,507 | A | 8/1982 | Spooner |
| 4,348,184 | A | 9/1982 | Moore |
| 4,348,185 | A | 9/1982 | Breglia et al. |
| 4,348,186 | A | 9/1982 | Harvey et al. |
| 4,349,815 | A | 9/1982 | Spooner |
| 4,356,730 | A | 11/1982 | Cade |
| 4,360,884 | A | 11/1982 | Okada et al. |
| 4,375,685 | A | 3/1983 | Le Goff et al. |
| 4,384,324 | A | 5/1983 | Kim et al. |
| 4,390,253 | A | 6/1983 | Lobb |
| 4,393,394 | A | 7/1983 | McCoy |
| 4,394,727 | A | 7/1983 | Hoffman et al. |
| 4,398,794 | A | 8/1983 | Palmer et al. |
| 4,398,795 | A | 8/1983 | Palmer |
| 4,399,861 | A | 8/1983 | Carlson |
| 4,408,884 | A | 10/1983 | Kleinknecht et al. |
| 4,422,019 | A | 12/1983 | Meyer |
| 4,427,274 | A | 1/1984 | Pund et al. |
| 4,431,260 | A | 2/1984 | Palmer |
| 4,435,756 | A | 3/1984 | Potash |
| 4,437,113 | A | 3/1984 | Lee et al. |
| 4,439,157 | A | 3/1984 | Breglia et al. |
| 4,440,839 | A | 4/1984 | Mottier |
| 4,441,791 | A | 4/1984 | Horbeck |
| 4,445,197 | A | 4/1984 | Lorie et al. |
| 4,446,480 | A | 5/1984 | Breglia et al. |
| 4,463,372 | A | 7/1984 | Bennett et al. |
| 4,466,123 | A | 8/1984 | Arai et al. |
| 4,471,433 | A | 9/1984 | Matsumoto et al. |
| 4,472,732 | A | 9/1984 | Bennett et al. |
| 4,487,584 | A | 12/1984 | Allen et al. |
| 4,492,435 | A | 1/1985 | Banton et al. |
| 4,498,136 | A | 2/1985 | Sproul, III |
| 4,499,457 | A | 2/1985 | Hintze |
| 4,500,163 | A | 2/1985 | Burns et al. |
| 4,511,337 | A | 4/1985 | Fortunato et al. |
| 4,536,058 | A | 8/1985 | Shaw et al. |
| 4,539,638 | A | 9/1985 | Gaffney |
| 4,546,431 | A | 10/1985 | Horvath |
| 4,566,935 | A | 1/1986 | Hornbeck |
| 4,570,233 | A | 2/1986 | Yan et al. |
| 4,582,396 | A | 4/1986 | Bos et al. |
| 4,583,185 | A | 4/1986 | Heartz |
| 4,586,037 | A | 4/1986 | Rosener et al. |
| 4,586,038 | A | 4/1986 | Sims et al. |
| 4,589,093 | A | 5/1986 | Ippolito et al. |
| 4,590,555 | A | 5/1986 | Bourrez |
| 4,591,844 | A | 5/1986 | Hickin et al. |
| 4,596,992 | A | 6/1986 | Hornbeck |
| 4,597,633 | A | 7/1986 | Fussell |
| 4,598,372 | A | 7/1986 | McRoberts |
| 4,599,070 | A | 7/1986 | Hladky et al. |
| 4,609,939 | A | 9/1986 | Kozawa et al. |
| 4,616,217 | A | 10/1986 | Nesbitt et al. |
| 4,616,262 | A | 10/1986 | Toriumi et al. |
| 4,623,223 | A | 11/1986 | Kempf |
| 4,623,880 | A | 11/1986 | Bresenham et al. |
| 4,625,289 | A | 11/1986 | Rockwood |
| 4,630,101 | A | 12/1986 | Inaba et al. |
| 4,630,884 | A | 12/1986 | Jubinski |
| 4,631,690 | A | 12/1986 | Corthout et al. |
| 4,633,243 | A | 12/1986 | Bresenham et al. |

4,634,384 A 1/1987 Neves et al.
4,636,031 A 1/1987 Schmadel, Jr. et al.
4,636,384 A 1/1987 Stolle et al.
4,642,756 A 2/1987 Sherrod
4,642,790 A 2/1987 Minshull et al.
4,642,945 A 2/1987 Browning et al.
4,645,459 A 2/1987 Graf et al.
4,646,251 A 2/1987 Hayes et al.
4,647,966 A 3/1987 Phillips et al.
4,655,539 A 4/1987 Caulfield et al.
4,656,506 A 4/1987 Ritchey
4,656,578 A 4/1987 Chilinski et al.
4,657,512 A 4/1987 Mecklenborg
4,658,351 A 4/1987 Teng
4,662,746 A 5/1987 Hornbeck
4,663,617 A 5/1987 Stockwell
4,671,650 A 6/1987 Hirzel et al.
4,672,215 A 6/1987 Howard
4,672,275 A 6/1987 Ando
4,677,576 A 6/1987 Berlin, Jr. et al.
4,679,040 A 7/1987 Yan
4,684,215 A 8/1987 Shaw et al.
4,692,880 A 9/1987 Merz et al.
4,698,602 A 10/1987 Armitage
4,704,605 A 11/1987 Edelson
4,710,732 A 12/1987 Hornbeck
4,714,428 A 12/1987 Bunker et al.
4,715,005 A 12/1987 Heartz
4,720,705 A 1/1988 Gupta et al.
4,720,747 A 1/1988 Crowley
4,725,110 A 2/1988 Glenn et al.
4,727,365 A 2/1988 Bunker et al.
4,730,261 A 3/1988 Smith
4,731,859 A 3/1988 Holter et al.
4,735,410 A 4/1988 Nobuta
4,743,200 A 5/1988 Welch et al.
4,744,615 A 5/1988 Fan et al.
4,748,572 A 5/1988 Latham
4,751,509 A 6/1988 Kubota et al.
4,760,388 A 7/1988 Tatsumi et al.
4,760,917 A 8/1988 Vitek
4,761,253 A 8/1988 Antes
4,763,280 A 8/1988 Robinson et al.
4,766,555 A 8/1988 Bennett
4,769,762 A 9/1988 Tsujido
4,772,881 A 9/1988 Hannah
4,777,620 A 10/1988 Shimoni et al.
4,780,084 A 10/1988 Donovan
4,780,711 A 10/1988 Doumas
4,791,583 A 12/1988 Colburn
4,794,386 A 12/1988 Bedrij et al.
4,795,226 A 1/1989 Bennion et al.
4,796,020 A 1/1989 Budrikis et al.
4,799,106 A 1/1989 Moore et al.
4,805,107 A 2/1989 Kieckhafer et al.
4,807,158 A 2/1989 Blanton et al.
4,807,183 A 2/1989 Kung et al.
4,811,245 A 3/1989 Bunker et al.
4,812,988 A 3/1989 Duthuit et al.
4,821,212 A 4/1989 Heartz
4,825,391 A 4/1989 Merz
4,833,528 A 5/1989 Kobayashi
4,837,740 A 6/1989 Sutherland
4,854,669 A 8/1989 Birnbach et al.
4,855,934 A 8/1989 Robinson
4,855,937 A 8/1989 Heartz
4,855,939 A 8/1989 Fitzgerald, Jr. et al.
4,855,943 A 8/1989 Lewis
4,856,869 A 8/1989 Sakata et al.
4,868,766 A 9/1989 Ooosterholt
4,868,771 A 9/1989 Quick et al.
4,873,515 A 10/1989 Dickson et al.
4,884,275 A 11/1989 Simms
4,885,703 A 12/1989 Deering
4,893,353 A 1/1990 Iwaoka et al.
4,893,515 A 1/1990 Uchida
4,897,715 A 1/1990 Beamon, III
4,899,293 A 2/1990 Dawson et al.
4,907,237 A 3/1990 Dahmani et al.
4,912,526 A 3/1990 Iwaoka et al.
4,915,463 A 4/1990 Barbee, Jr.
4,918,626 A 4/1990 Watkins et al.
4,930,888 A 6/1990 Freisleben et al.
4,935,879 A 6/1990 Ueda
4,938,584 A 7/1990 Suematsu et al.
4,940,972 A 7/1990 Mouchot et al.
4,949,280 A 8/1990 Littlefield
4,952,152 A 8/1990 Briggs et al.
4,952,922 A 8/1990 Griffin et al.
4,953,107 A 8/1990 Hedley et al.
4,954,819 A 9/1990 Watkins
4,955,034 A 9/1990 Scerbak
4,959,541 A * 9/1990 Boyd ..... 250/237 R
4,959,803 A 9/1990 Kiyohara et al.
4,969,714 A 11/1990 Fournier, Jr. et al.
4,970,500 A 11/1990 Hintze
4,974,155 A 11/1990 Dulong et al.
4,974,176 A 11/1990 Buchner et al.
4,982,178 A 1/1991 Hintze
4,984,824 A 1/1991 Antes et al.
4,985,831 A 1/1991 Dulong et al.
4,985,854 A 1/1991 Wittenburg
4,991,955 A 2/1991 Vetter
4,992,780 A 2/1991 Penna et al.
4,994,794 A 2/1991 Price et al.
5,005,005 A 4/1991 Brossia et al.
5,007,705 A 4/1991 Morey et al.
5,011,276 A 4/1991 Iwamoto
5,016,643 A 5/1991 Applegate et al.
5,022,732 A 6/1991 Engan et al.
5,022,750 A 6/1991 Flasck
5,023,725 A 6/1991 McCutchen
5,023,818 A 6/1991 Wittensoldner et al.
5,025,394 A 6/1991 Parke
5,025,400 A 6/1991 Cook et al.
5,035,473 A 7/1991 Kuwayama et al.
5,038,352 A 8/1991 Lenth et al.
5,043,924 A 8/1991 Hofmann
5,047,626 A 9/1991 Bobb et al.
5,053,698 A 10/1991 Ueda
5,058,992 A 10/1991 Takahashi
5,059,019 A 10/1991 McCullough
5,061,075 A * 10/1991 Alfano et al. ..... 356/417
5,061,919 A 10/1991 Watkins
5,063,375 A 11/1991 Lien et al.
5,077,608 A 12/1991 Dubner
5,088,095 A 2/1992 Zirngibl
5,089,903 A 2/1992 Kuwayama et al.
5,095,491 A 3/1992 Kozlovsky et al.
5,097,427 A 3/1992 Lathrop et al.
5,101,184 A 3/1992 Antes
5,103,306 A 4/1992 Weiman et al.
5,103,339 A 4/1992 Broome
5,111,468 A 5/1992 Kozlovsky et al.
5,113,455 A 5/1992 Scott
5,115,127 A 5/1992 Bobb et al.
5,117,221 A 5/1992 Mishica, Jr.
RE33,973 E 6/1992 Kriz et al.
5,121,086 A 6/1992 Srivastava
5,123,085 A 6/1992 Wells et al.
5,124,821 A 6/1992 Antier et al.
5,132,812 A 7/1992 Takahashi et al.
5,134,521 A 7/1992 Lacroix et al.
5,136,675 A 8/1992 Hodson
5,136,818 A 8/1992 Bramson
5,142,788 A 9/1992 Willetts
5,155,604 A 10/1992 Miekka et al.
5,157,385 A 10/1992 Nakao et al.
5,159,601 A 10/1992 Huber
5,161,013 A 11/1992 Rylander et al.
5,175,575 A 12/1992 Gersuk
5,179,638 A 1/1993 Dawson et al.
5,185,852 A 2/1993 Mayer
5,194,969 A 3/1993 DiFrancesco
5,196,922 A 3/1993 Yeomans
5,198,661 A 3/1993 Anderson et al.
5,200,818 A 4/1993 Neta et al.
5,206,868 A 4/1993 Deacon 5,214,757 A 5/1993 Mauney et al.
5,222,205 A 6/1993 Larson et al.
5,226,109 A 7/1993 Dawson et al.
5,227,863 A 7/1993 Bilbrey et al.
5,229,593 A 7/1993 Cato
5,230,039 A 7/1993 Grossman et al.
5,231,388 A 7/1993 Stoltz
5,239,625 A 8/1993 Bogart et al.
5,241,659 A 8/1993 Parulski et al.
5,242,306 A 9/1993 Fisher
5,243,448 A 9/1993 Banbury
5,251,160 A 10/1993 Rockwood et al.
5,252,068 A 10/1993 Gryder
5,255,274 A 10/1993 Wysocki et al.
5,266,930 A 11/1993 Ichikawa et al.
5,267,045 A 11/1993 Stroomer
5,272,473 A 12/1993 Thompson et al.
5,276,849 A 1/1994 Patel
5,285,397 A 2/1994 Heier et al.
5,291,317 A 3/1994 Newswanger
5,293,233 A 3/1994 Billing et al.
5,297,156 A 3/1994 Deacon
5,300,942 A 4/1994 Dolgoff
5,301,062 A 4/1994 Takahashi et al.
5,311,360 A 5/1994 Bloom et al.
5,315,699 A 5/1994 Imai et al.
5,317,576 A 5/1994 Leonberger et al.
5,317,689 A 5/1994 Nack et al.
5,319,744 A 6/1994 Kelly et al.
5,320,353 A 6/1994 Moore
5,320,534 A 6/1994 Thomas
5,325,133 A 6/1994 Adachi
5,325,485 A 6/1994 Hochmuth et al.
5,326,266 A 7/1994 Fisher et al.
5,329,323 A 7/1994 Biles
5,333,021 A 7/1994 Mitsutake et al.
5,333,245 A 7/1994 Vecchione
5,341,460 A 8/1994 Tam
5,345,280 A 9/1994 Kimura et al.
5,347,433 A 9/1994 Sedlmayr
5,347,620 A 9/1994 Zimmer
5,348,477 A 9/1994 Welch et al.
5,353,390 A 10/1994 Harrington
5,357,579 A 10/1994 Buchner et al.
5,359,526 A 10/1994 Whittington et al.
5,359,704 A 10/1994 Rossignac et al.
5,360,010 A 11/1994 Applegate et al.
5,361,386 A 11/1994 Watkins et al.
5,363,220 A 11/1994 Kuwayama et al.
5,363,475 A 11/1994 Baker et al.
5,363,476 A 11/1994 Kurashige et al.
5,367,585 A 11/1994 Ghezzo et al.
5,367,615 A 11/1994 Economy et al.
5,369,450 A 11/1994 Haseltine et al.
5,369,735 A 11/1994 Thier et al.
5,369,739 A 11/1994 Akeley
5,377,320 A 12/1994 Abi-Ezzi et al.
5,379,371 A 1/1995 Usami et al.
5,380,995 A 1/1995 Udd et al.
5,381,338 A 1/1995 Wysocki et al.
5,381,519 A 1/1995 Brown et al.
5,384,719 A 1/1995 Baker et al.
5,388,206 A 2/1995 Poulton et al.
5,394,414 A 2/1995 Kozlovsky et al.
5,394,515 A 2/1995 Lentz et al.
5,394,516 A 2/1995 Winser
5,396,349 A 3/1995 Roberts et al.
5,398,083 A 3/1995 Tsujihara et al.
5,408,249 A 4/1995 Wharton et al.
5,408,606 A 4/1995 Eckart
5,410,371 A 4/1995 Lambert
5,412,796 A 5/1995 Olive
5,422,986 A 6/1995 Neely
5,430,888 A 7/1995 Witek et al.
5,432,863 A 7/1995 Benati et al.
5,444,839 A 8/1995 Silverbrook et al.
5,451,765 A 9/1995 Gerber
5,459,610 A 10/1995 Bloom et al.
5,459,835 A 10/1995 Trevett
5,465,121 A 11/1995 Blalock et al.
5,465,368 A 11/1995 Davidson et al.
5,471,545 A 11/1995 Negami et al.
5,471,567 A 11/1995 Soderberg et al.
5,473,373 A 12/1995 Hwung et al.
5,473,391 A 12/1995 Usui
5,479,597 A 12/1995 Fellous
5,480,305 A 1/1996 Montag et al.
5,487,665 A 1/1996 Lechner et al.
5,488,687 A 1/1996 Rich
5,489,920 A 2/1996 Kaasila
5,490,238 A 2/1996 Watkins
5,490,240 A 2/1996 Foran et al.
5,493,439 A 2/1996 Engle
5,493,629 A 2/1996 Stange
5,495,563 A 2/1996 Winser
5,499,194 A 3/1996 Prestidge et al.
5,500,747 A 3/1996 Tanide et al.
5,500,761 A 3/1996 Goossen et al.
5,502,482 A 3/1996 Graham
5,502,782 A 3/1996 Smith
5,504,496 A 4/1996 Tanaka et al.
5,506,949 A 4/1996 Perrin
5,519,518 A 5/1996 Watanabe et al.
5,535,374 A 7/1996 Olive
5,536,085 A 7/1996 Li et al.
5,537,159 A 7/1996 Suematsu et al.
5,539,577 A 7/1996 Si et al.
5,541,769 A 7/1996 Ansley et al.
5,544,306 A 8/1996 Deering et al.
5,544,340 A 8/1996 Doi et al.
5,550,960 A 8/1996 Shirman et al.
5,551,283 A 9/1996 Manaka et al.
5,557,297 A 9/1996 Sharp et al.
5,557,733 A 9/1996 Hicok et al.
5,559,952 A 9/1996 Fujimoto
5,559,954 A 9/1996 Sakoda et al.
5,561,745 A 10/1996 Jackson et al.
5,566,370 A 10/1996 Young
5,572,229 A 11/1996 Fisher
5,574,847 A 11/1996 Eckart et al.
5,579,456 A 11/1996 Cosman
5,584,696 A 12/1996 Walker et al.
5,586,291 A 12/1996 Lasker et al.
5,590,254 A 12/1996 Lippincott et al.
5,594,854 A 1/1997 Baldwin et al.
5,598,517 A 1/1997 Watkins
5,604,849 A 2/1997 Artwick et al.
5,610,665 A 3/1997 Berman et al.
5,612,710 A 3/1997 Christensen et al.
5,614,961 A 3/1997 Gibeau et al.
5,625,768 A 4/1997 Dye
5,627,605 A 5/1997 Kim
5,629,801 A 5/1997 Staker et al.
5,630,037 A 5/1997 Schindler
5,633,750 A 5/1997 Nogiwa et al.
5,638,208 A 6/1997 Walker
5,648,860 A 7/1997 Ooi et al.
5,650,814 A 7/1997 Florent et al.
5,651,104 A 7/1997 Cosman
5,657,077 A 8/1997 DeAngelis et al.
5,658,060 A 8/1997 Dove
5,659,490 A 8/1997 Imamura
5,659,671 A 8/1997 Tannenbaum et al.
5,661,592 A 8/1997 Bornstein et al.
5,661,593 A 8/1997 Engle
5,665,942 A 9/1997 Williams et al.
5,677,783 A 10/1997 Bloom et al.
5,684,939 A 11/1997 Foran et al.
5,684,943 A 11/1997 Abraham et al.
5,689,437 A 11/1997 Nakagawa
5,691,999 A 11/1997 Ball et al.
5,694,180 A 12/1997 Deter et al.
5,696,892 A 12/1997 Redmann et al.
5,696,947 A 12/1997 Johns et al.
5,699,497 A 12/1997 Erdahl et al.
5,703,604 A 12/1997 McCutchen
5,706,061 A 1/1998 Marshall et al.
5,715,021 A 2/1998 Gibeau et al.

5,719,951 A 2/1998 Shackleton et al.
5,724,561 A 3/1998 Tarolli et al.
5,726,785 A 3/1998 Chawki et al.
5,734,386 A 3/1998 Cosman
5,734,521 A 3/1998 Fukudome et al.
5,739,819 A 4/1998 Bar-Nahum
5,740,190 A 4/1998 Moulton
5,742,749 A 4/1998 Foran et al.
5,748,264 A 5/1998 Hegg
5,748,867 A 5/1998 Cosman et al.
5,761,709 A 6/1998 Kranich
5,764,280 A 6/1998 Bloom et al.
5,764,311 A 6/1998 Bonde et al.
5,768,443 A 6/1998 Michael et al.
5,781,666 A 7/1998 Ishizawa et al.
5,793,912 A 8/1998 Boord et al.
5,798,743 A 8/1998 Bloom
5,808,797 A 9/1998 Bloom et al.
5,818,456 A 10/1998 Cosman et al.
5,818,998 A 10/1998 Harris et al.
5,821,944 A 10/1998 Watkins
5,825,363 A 10/1998 Anderson
5,825,538 A 10/1998 Walker
5,835,256 A 11/1998 Huibers
5,837,996 A 11/1998 Keydar
5,838,328 A 11/1998 Roller
5,838,484 A 11/1998 Goossen
5,841,443 A 11/1998 Einkauf
5,841,447 A 11/1998 Drews
5,841,579 A 11/1998 Bloom et al.
5,850,225 A 12/1998 Cosman
5,854,631 A 12/1998 Akeley et al.
5,854,865 A 12/1998 Goldberg
5,860,721 A 1/1999 Bowron et al.
5,864,342 A 1/1999 Kajiya et al.
5,867,166 A 2/1999 Myhrvold et al.
5,867,301 A 2/1999 Engle
5,870,097 A 2/1999 Snyder et al.
5,870,098 A 2/1999 Gardiner
5,874,967 A 2/1999 West et al.
5,889,529 A 3/1999 Jones et al.
5,900,881 A 5/1999 Ikedo
5,903,272 A 5/1999 Otto
5,905,504 A 5/1999 Barkans et al.
5,908,300 A 6/1999 Walker et al.
5,909,225 A 6/1999 Schinnerer et al.
5,912,670 A 6/1999 Lipscomb et al.
5,912,740 A 6/1999 Zare et al.
5,917,495 A 6/1999 Doi et al.
5,920,361 A 7/1999 Gibeau et al.
5,923,333 A 7/1999 Stroyan
5,930,740 A 7/1999 Mathisen
5,943,060 A 8/1999 Cosman et al.
5,946,129 A 8/1999 Xu et al.
5,963,788 A 10/1999 Barron et al.
5,969,699 A 10/1999 Balram et al.
5,969,721 A 10/1999 Chen et al.
5,969,726 A 10/1999 Rentschler et al.
5,974,059 A 10/1999 Dawson
5,977,977 A 11/1999 Kajiya et al.
5,980,044 A 11/1999 Cannon et al.
5,982,553 A 11/1999 Bloom et al.
5,987,200 A 11/1999 Fleming et al.
5,988,814 A 11/1999 Rohlfing et al.
5,990,935 A 11/1999 Rohlfing
5,999,549 A 12/1999 Freitag et al.
6,002,454 A 12/1999 Kajiwara et al.
6,002,505 A 12/1999 Kraenert et al.
6,005,580 A 12/1999 Donovan
6,005,611 A 12/1999 Gullichsen et al.
6,014,144 A 1/2000 Nelson et al.
6,014,163 A 1/2000 Houskeeper
6,021,141 A 2/2000 Nam et al.
6,031,541 A 2/2000 Lipscomb et al.
6,034,739 A 3/2000 Rohlfing et al.
6,038,057 A 3/2000 Brazas, Jr. et al.
6,042,238 A 3/2000 Blackham et al.
6,052,125 A 4/2000 Gardiner et al.
6,052,485 A 4/2000 Nelson et al.
6,057,909 A 5/2000 Yahav et al.
6,064,392 A 5/2000 Rohner
6,064,393 A 5/2000 Lengyel et al.
6,069,903 A 5/2000 Zanger et al.
6,072,500 A 6/2000 Foran et al.
6,072,544 A 6/2000 Gleim et al.
6,078,333 A 6/2000 Wittig et al.
6,084,610 A 7/2000 Ozaki et al.
6,094,226 A 7/2000 Ke et al.
6,094,267 A 7/2000 Levenson et al.
6,094,298 A 7/2000 Luo et al.
6,100,906 A 8/2000 Asaro et al.
6,101,036 A 8/2000 Bloom
6,108,054 A 8/2000 Heizmann et al.
6,111,616 A 8/2000 Chauvin et al.
6,122,413 A 9/2000 Jiang et al.
6,124,647 A 9/2000 Marcus et al.
6,124,808 A 9/2000 Budnovitch
6,124,922 A 9/2000 Sentoku
6,124,989 A 9/2000 Oode et al.
6,126,288 A 10/2000 Hewlett
6,128,019 A 10/2000 Crocker, III et al.
6,128,021 A 10/2000 van der Meulen et al.
6,130,770 A 10/2000 Bloom
6,134,339 A 10/2000 Luo
6,137,565 A 10/2000 Ecke et al.
6,137,932 A 10/2000 Kim et al.
6,141,013 A 10/2000 Nelson et al.
6,141,025 A 10/2000 Oka et al.
6,144,481 A 11/2000 Kowarz et al.
6,147,690 A 11/2000 Cosman
6,147,695 A 11/2000 Bowen et al.
6,147,789 A 11/2000 Gelbart
6,154,259 A 11/2000 Hargis et al.
6,175,579 B1 1/2001 Sandford et al.
6,184,888 B1 2/2001 Yuasa et al.
6,184,891 B1 2/2001 Blinn
6,184,926 B1 2/2001 Khosravi et al.
6,188,427 B1 * 2/2001 Anderson et al. ..... 347/255
6,188,712 B1 2/2001 Jiang et al.
6,191,827 B1 2/2001 Segman et al.
6,195,099 B1 2/2001 Gardiner
6,195,484 B1 2/2001 Brennan, III et al.
6,195,609 B1 2/2001 Pilley et al.
6,204,859 B1 3/2001 Jouppi et al.
6,204,955 B1 3/2001 Chao et al.
6,215,579 B1 4/2001 Bloom et al.
6,219,015 B1 4/2001 Bloom et al.
6,222,937 B1 4/2001 Cohen et al.
6,229,650 B1 5/2001 Reznichenko et al.
6,229,827 B1 5/2001 Fernald et al.
6,233,025 B1 5/2001 Wallenstein
6,236,408 B1 5/2001 Watkins
6,240,220 B1 5/2001 Pan et al.
6,262,739 B1 7/2001 Migdal et al.
6,262,810 B1 7/2001 Bloomer
6,263,002 B1 7/2001 Hsu et al.
6,266,068 B1 7/2001 Kang et al.
6,268,861 B1 7/2001 Sanz-Pastor et al.
6,282,012 B1 8/2001 Kowarz et al.
6,282,220 B1 8/2001 Floyd
6,285,407 B1 9/2001 Yasuki et al.
6,285,446 B1 9/2001 Farhadiroushan
6,292,165 B1 9/2001 Lin et al.
6,292,268 B1 9/2001 Hirota et al.
6,292,310 B1 9/2001 Chao
6,297,899 B1 10/2001 Romanovsky
6,298,066 B1 10/2001 Wettroth et al.
6,301,370 B1 10/2001 Steffens et al.
6,304,245 B1 10/2001 Groenenboom
6,307,558 B1 10/2001 Mao
6,307,663 B1 10/2001 Kowarz
6,308,144 B1 10/2001 Bronfeld et al.
6,320,688 B1 11/2001 Westbrook et al.
6,323,984 B1 11/2001 Trisnadi
6,333,792 B1 12/2001 Kimura
6,333,803 B1 12/2001 Kurotori et al.
6,335,765 B1 1/2002 Daly et al.
6,335,941 B1 1/2002 Grubb et al.

6,340,806 B1 1/2002 Smart et al.
6,356,683 B1 3/2002 Hu et al.
6,360,042 B1 3/2002 Long
6,361,173 B1 3/2002 Vlahos et al.
6,362,817 B1 3/2002 Powers et al.
6,362,818 B1 3/2002 Gardiner et al.
6,363,089 B1 3/2002 Fernald et al.
6,366,721 B1 4/2002 Hu et al.
6,369,936 B1 4/2002 Moulin
6,370,312 B1 4/2002 Wagoner et al.
6,374,011 B1 4/2002 Wagoner et al.
6,374,015 B1 4/2002 Lin
6,375,366 B1 4/2002 Kato et al.
6,381,072 B1 4/2002 Burger
6,381,385 B1 4/2002 Watley et al.
6,384,828 B1 5/2002 Arbeiter et al.
6,388,241 B1 5/2002 Ang
6,393,036 B1 5/2002 Kato
6,393,181 B1 5/2002 Bulman et al.
6,396,994 B1 5/2002 Philipson et al.
6,404,425 B1 6/2002 Cosman
6,407,736 B1 6/2002 Regan
6,411,425 B1 6/2002 Kowarz et al.
6,421,636 B1 7/2002 Cooper et al.
6,424,343 B1 7/2002 Deering et al.
6,429,876 B1 8/2002 Morein
6,429,877 B1 8/2002 Stroyan
6,433,823 B1 8/2002 Nakamura et al.
6,433,838 B1 8/2002 Chen
6,433,840 B1 8/2002 Poppleton
6,437,789 B1 8/2002 Tidwell et al.
6,445,362 B1 9/2002 Tegreene
6,445,433 B1 9/2002 Levola
6,449,071 B1 9/2002 Farhan et al.
6,449,293 B1 9/2002 Pedersen et al.
6,452,667 B1 9/2002 Fernald et al.
6,456,288 B1 9/2002 Brockway et al.
6,466,206 B1 10/2002 Deering
6,466,224 B1 10/2002 Nagata et al.
6,470,036 B1 10/2002 Bailey et al.
6,473,090 B1 10/2002 Mayer
6,476,848 B2 11/2002 Kowarz et al.
6,480,513 B1 11/2002 Kapany et al.
6,480,634 B1 11/2002 Corrigan
6,490,931 B1 12/2002 Fernald et al.
6,496,160 B1 12/2002 Tanner et al.
6,507,706 B1 1/2003 Brazas et al.
6,510,272 B1 1/2003 Wiegand
6,511,182 B1 1/2003 Agostinelli et al.
RE37,993 E 2/2003 Zhang
6,519,388 B1 2/2003 Fernald et al.
6,522,809 B1 2/2003 Takabayashi et al.
6,525,740 B1 2/2003 Cosman
6,529,310 B1 3/2003 Huibers et al.
6,529,531 B1 3/2003 Everage et al.
6,534,248 B2 3/2003 Jain et al.
6,538,656 B1 3/2003 Cheung et al.
6,549,196 B1 4/2003 Taguchi et al.
6,554,431 B1 4/2003 Binsted et al.
6,556,627 B2 4/2003 Kitamura et al.
6,563,968 B2 5/2003 Davis et al.
6,574,352 B1 6/2003 Skolmoski
6,575,581 B2 6/2003 Tsurushima
6,577,429 B1 6/2003 Kurtz et al.
6,580,430 B1 6/2003 Hollis et al.
6,591,020 B1 7/2003 Klassen
6,594,043 B1 7/2003 Bloom et al.
6,597,363 B1 7/2003 Duluk, Jr. et al.
6,598,979 B2 7/2003 Yoneno
6,600,460 B1 7/2003 Mays, Jr.
6,600,830 B1 7/2003 Lin et al.
6,600,854 B2 7/2003 Anderegg et al.
6,603,482 B1 8/2003 Tidwell
6,643,299 B1 11/2003 Lin
6,646,645 B2 11/2003 Simmonds et al.
6,650,326 B1 11/2003 Huber et al.
6,671,293 B2 12/2003 Kopp et al.
6,678,085 B2 1/2004 Kowarz et al.
6,690,655 B1 2/2004 Miner et al.
6,692,129 B2 2/2004 Gross et al.
6,711,187 B2 3/2004 Tanner et al.
6,727,918 B1 4/2004 Nason
6,738,105 B1 5/2004 Hannah et al.
6,741,384 B1 5/2004 Martin et al.
6,747,649 B1 6/2004 Sanz-Pastor et al.
6,747,781 B2 6/2004 Trisnadi
6,751,001 B1 6/2004 Tanner et al.
6,760,036 B2 7/2004 Tidwell
6,763,042 B2 7/2004 Williams et al.
6,773,142 B2 8/2004 Rekow
6,776,045 B2 8/2004 Fernald et al.
6,782,205 B2 8/2004 Trisnadi et al.
6,788,304 B1 9/2004 Hart et al.
6,788,307 B2 9/2004 Coleman et al.
6,789,903 B2 9/2004 Parker et al.
6,791,562 B2 9/2004 Cosman et al.
6,798,418 B1 9/2004 Sartori et al.
6,799,850 B2 10/2004 Hong et al.
6,801,205 B2 10/2004 Gardiner et al.
6,809,731 B2 10/2004 Muffler et al.
6,811,267 B1 11/2004 Allen et al.
6,816,169 B2 11/2004 Cosman
6,831,648 B2 12/2004 Mukherjee et al.
6,840,627 B2 1/2005 Olbrich
6,842,298 B1 1/2005 Shafer et al.
6,856,449 B2 2/2005 Winkler et al.
6,868,212 B2 3/2005 DeWitte et al.
6,871,958 B2 3/2005 Streid et al.
6,897,878 B2 5/2005 Cosman et al.
6,943,803 B1 9/2005 Cosman et al.
6,956,582 B2 10/2005 Tidwell
6,956,878 B1 10/2005 Trisnadi
6,971,576 B2 12/2005 Tsikos et al.
6,984,039 B2 1/2006 Agostinelli
6,985,663 B2 1/2006 Catchmark et al.
7,012,669 B2 3/2006 Streid et al.
7,030,883 B2 4/2006 Thompson
7,038,735 B2 5/2006 Coleman et al.
7,043,102 B2 5/2006 Okamoto et al.
7,053,911 B2 5/2006 Cosman
7,053,912 B2 5/2006 Cosman
7,053,913 B2 5/2006 Cosman
7,054,051 B1 5/2006 Bloom
7,091,980 B2 8/2006 Tidwell
7,095,423 B2 8/2006 Cosman et al.
7,110,153 B2 9/2006 Sakai
7,110,624 B2 9/2006 Williams et al.
7,111,943 B2 9/2006 Agostinelli et al.
7,113,320 B2 9/2006 Tanner
7,133,583 B2 11/2006 Marceau et al.
7,193,765 B2 3/2007 Christensen et al.
7,193,766 B2 3/2007 Bloom
7,197,200 B2 3/2007 Marceau et al.
7,210,786 B2 5/2007 Tamura et al.
7,215,840 B2 5/2007 Marceau et al.
7,257,519 B2 8/2007 Cosman
7,267,442 B2 9/2007 Childers et al.
7,277,216 B2 10/2007 Bloom
7,286,277 B2 10/2007 Bloom et al.
7,317,464 B2 1/2008 Willis
7,327,909 B2 2/2008 Marceau et al.
7,334,902 B2 2/2008 Streid et al.
7,354,157 B2 4/2008 Takeda et al.
7,400,449 B2 7/2008 Christensen et al.
7,420,177 B2 9/2008 Williams et al.
2001/0002124 A1 5/2001 Mamiya et al.
2001/0027456 A1 10/2001 Lancaster et al.
2001/0047251 A1 11/2001 Kemp
2002/0005862 A1 1/2002 Deering
2002/0021462 A1 2/2002 Delfyett et al.
2002/0067467 A1 6/2002 Dorval et al.
2002/0071453 A1 6/2002 Lin
2002/0075202 A1 6/2002 Fergason
2002/0101647 A1 8/2002 Moulin
2002/0136121 A1 9/2002 Salmonsen et al.
2002/0145615 A1 10/2002 Moore
2002/0145806 A1 10/2002 Amm
2002/0146248 A1 10/2002 Herman et al.

| | | | | |
|---|---|---|---|---|
| 2002/0154860 | A1 | 10/2002 | Fernald et al. | |
| 2002/0176134 | A1 | 11/2002 | Vohra | |
| 2003/0035190 | A1 | 2/2003 | Brown et al. | |
| 2003/0038807 | A1 | 2/2003 | Demos et al. | |
| 2003/0039443 | A1 | 2/2003 | Catchmark et al. | |
| 2003/0048275 | A1 | 3/2003 | Ciolac | |
| 2003/0081303 | A1 | 5/2003 | Sandstrom et al. | |
| 2003/0086647 | A1 | 5/2003 | Willner et al. | |
| 2003/0142319 | A1 | 7/2003 | Ronnekleiv et al. | |
| 2003/0160780 | A1 | 8/2003 | Lefebvre et al. | |
| 2003/0174312 | A1 | 9/2003 | Leblanc | |
| 2003/0214633 | A1 | 11/2003 | Roddy et al. | |
| 2003/0235304 | A1 | 12/2003 | Evans et al. | |
| 2004/0017518 | A1 | 1/2004 | Stern et al. | |
| 2004/0085283 | A1 | 5/2004 | Wang | |
| 2004/0136074 | A1 | 7/2004 | Ford et al. | |
| 2004/0165154 | A1 | 8/2004 | Kobori et al. | |
| 2004/0179007 | A1 | 9/2004 | Bower et al. | |
| 2004/0183954 | A1 | 9/2004 | Hannah et al. | |
| 2004/0196660 | A1* | 10/2004 | Usami | 362/458 |
| 2004/0207618 | A1 | 10/2004 | Williams et al. | |
| 2005/0018309 | A1 | 1/2005 | McGuire, Jr. et al. | |
| 2005/0024722 | A1 | 2/2005 | Agostinelli et al. | |
| 2005/0047134 | A1 | 3/2005 | Mueller et al. | |
| 2005/0093854 | A1 | 5/2005 | Kennedy et al. | |
| 2005/0243389 | A1 | 11/2005 | Kihara | |
| 2006/0039051 | A1* | 2/2006 | Baba et al. | 359/35 |
| 2006/0114544 | A1 | 6/2006 | Bloom et al. | |
| 2006/0176912 | A1 | 8/2006 | Anikitchev | |
| 2006/0221429 | A1 | 10/2006 | Christensen et al. | |
| 2006/0238851 | A1 | 10/2006 | Bloom | |
| 2006/0255243 | A1 | 11/2006 | Kobayashi et al. | |
| 2007/0183473 | A1 | 8/2007 | Bicknell et al. | |
| 2008/0037125 | A1* | 2/2008 | Takamiya | 359/568 |
| 2008/0218837 | A1* | 9/2008 | Yang et al. | 359/239 |

FOREIGN PATENT DOCUMENTS

| | | |
|---|---|---|
| DE | 197 21 416 | 1/1999 |
| EP | 0 155 858 | 9/1985 |
| EP | 0 306 308 | 3/1989 |
| EP | 0 319 165 | 7/1989 |
| EP | 0 417 039 | 3/1991 |
| EP | 0 480 570 | 4/1992 |
| EP | 0 488 326 | 6/1992 |
| EP | 0 489 594 | 6/1992 |
| EP | 0 528 646 | 2/1993 |
| EP | 0 530 760 | 3/1993 |
| EP | 0 550 189 | 7/1993 |
| EP | 0 610 665 | 8/1994 |
| EP | 0 621 548 | 10/1994 |
| EP | 0 627 644 | 12/1994 |
| EP | 0 627 850 | 12/1994 |
| EP | 0 643 314 | 3/1995 |
| EP | 0 654 777 | 5/1995 |
| EP | 0 658 868 | 6/1995 |
| EP | 0 689 078 | 12/1995 |
| EP | 0 801 319 | 10/1997 |
| EP | 0 880 282 | 11/1998 |
| EP | 1 365 584 | 11/2003 |
| GB | 2 118 365 | 10/1983 |
| GB | 2 144 608 | 3/1985 |
| GB | 2 179 147 | 2/1987 |
| GB | 2 245 806 | 1/1992 |
| GB | 2 251 770 | 7/1992 |
| GB | 2 251 773 | 7/1992 |
| GB | 2 266 385 | 10/1993 |
| GB | 2 293 079 | 3/1996 |
| JP | 63-305323 | 12/1988 |
| JP | 2-219092 | 8/1990 |
| JP | 2000-305481 | 11/2000 |
| WO | 87/01571 | 3/1987 |
| WO | 92/12506 | 7/1992 |
| WO | 93/02269 | 2/1993 |
| WO | 93/09472 | 5/1993 |
| WO | 93/18428 | 9/1993 |
| WO | 95/11473 | 4/1995 |
| WO | 95/27267 | 10/1995 |
| WO | 96/41217 | 12/1996 |
| WO | 96/41224 | 12/1996 |
| WO | 97/26569 | 7/1997 |
| WO | 98/15127 | 4/1998 |
| WO | 01/46248 | 6/2001 |
| WO | 01/57581 | 8/2001 |
| WO | 02/12925 | 2/2002 |
| WO | 02/23824 | 3/2002 |
| WO | 02/31575 | 4/2002 |
| WO | 03/001281 | 1/2003 |

OTHER PUBLICATIONS

Akeley, "RealityEngine Graphics," Computer Graphics Proceedings, Annual Conference Series, 1993.

Allen, J. et al., "An Interactive Learning Environment for VLSI Design," Proceedings of the IEEE, Jan. 2000, pp. 96-106, vol. 88, No. 1.

Allen, W. et al. "47.4:Invited Paper: Wobulation: Doubling the Addressed Resolution of Projection Displays," SID 05 Digest, 2005, pp. 1514-1517.

AMM, et al., "5.2: Grating Light Valve™ Technology: Update and Novel Applications," Presented at Society for Information Display Symposium, May 19, 1998, Anaheim, California.

Apgar et al., "A Display System for the Stellar™ Graphics Supercomputer Model GS1000™," Computer Graphics, Aug. 1988, pp. 255-262, vol. 22, No. 4.

Baer, Computer Systems Architecture, 1980, Computer Science Press, Inc., Rockville, Maryland.

Barad et al., "Real-Time Procedural Texturing Techniques Using MMX," Gamasutra, May 1, 1998, http://www.gamasutra.com/features/19980501/mmxtexturing_01.htm.

Bass, "4K GLV Calibration," E&S Company, Jan. 8, 2008.

Becker et al., "Smooth Transitions between Bump Rendering Algorithms," Computer Graphics Proceedings, 1993, pp. 183-189.

Bishop et al., "Frameless Rendering: Double Buffering Considered Harmful," Computer Graphics Proceedings, Annual Conference Series, 1994.

Blinn, "Simulation of Wrinkled Surfaces," Siggraph '78 Proceedings, 1978, pp. 286-292.

Blinn, "A Trip Down the Graphics Pipeline: Subpixelic Particles," IEEE Computer Graphics & Applications, Sep./Oct. 1991, pp. 86-90, vol. 11, No. 5.

Blinn et al., "Texture and Reflection in Computer Generated Images," Communications of the ACM, Oct. 1976, pp. 542-547, vol. 19, No. 10.

Bloom, "The Grating Light Valve: revolutionizing display technology," Silicon Light Machines, date unknown.

Boyd et al., "Parametric Interaction of Focused Gaussian Light Beams," Journal of Applied Physics, Jul. 1968, pp. 3597-3639 vol. 39, No. 8.

Brazas et al., "High-Resolution Laser-Projection Display System Using a Grating Electromechanical System (GEMS)," MOEMS Display and Imaging Systems II, Proceedings of SPIE, 2004, pp. 65-75 vol. 5348.

Bresenham, "Algorithm for computer control of a digital plotter," IBM Systems Journal, 1965, pp. 25-30, vol. 4, No. 1.

Carlson, "An Algorithm and Data Structure for 3D Object Synthesis Using Surface Patch Intersections," Computer Graphics, Jul. 1982, pp. 255-263, vol. 16, No. 3.

Carpenter, "The A-buffer, an Antialiased Hidden Surface Method," Computer Graphics, Jul. 1984, pp. 103-108, vol. 18, No. 3.

Carter, "Re: Re seams and creaseAngle (long)," posted on the GeoVRML.org website Feb. 2, 2000, http://www.ai.sri.com/geovrml/archive/msg00560.html.

Catmull, "An Analytic Visible Surface Algorithm for Independent Pixel Processing," Computer Graphics, Jul. 1984, pp. 109-115, vol. 18, No. 3.

Chasen, Geometric Principles and Procedures for Computer Graphic Applications, 1978, pp. 11-123, Upper Saddle River, New Jersey.

Choy et al., "Single Pass Algorithm for the Generation of Chain-Coded Contours and Contours Inclusion Relationship," Communications, Computers and Signal Processing - IEEE Pac Rim '93, 1993, pp. 256-259.

Clark et al., "Photographic Texture and CIG: Modeling Strategies for Production Data Bases," 9th VITSC Proceedings, Nov. 30-Dec. 2, 1987, pp. 274-283.
Corbin et al., "Grating Light Valve™ and Vehicle Displays," Silicon Light Machines, Sunnyvale, California, date unknown.
Corrigan et al., "Grating Light Valve™ Technology for Projection Displays," Presented at the International Display Workshop—Kobe, Japan, Dec. 9, 1998.
Crow, "Shadow Algorithms for Computer Graphics," Siggraph '77, Jul. 20-22, 1977, San Jose, California, pp. 242, 248.
Deering et al., "FBRAM: A new Form of Memory Optimized for 3D Graphics," Computer Graphics Proceedings, Annual Conference Series, 1994.
Drever et al., "Laser Phase and Frequency Stabilization Using an Optical Resonator," Applied Physics B: Photophysics and Laser Chemistry, 1983, pp. 97-105, vol. 31.
Duchaineau et al., "ROAMing Terrain: Real-time Optimally Adapting Meshes," Los Alamos National Laboratory and Lawrence Livermore National Laboratory, 1997.
Duff, "Compositing 3-D Rendered Images," Siggraph '85, Jul. 22-26, 1985, San Francisco, California, pp. 41-44.
Faux et al., Computational Geometry for Design and Manufacture, 1979, Ellis Horwood, Chicester, United Kingdom.
Feiner et al., "Dial: A Diagrammatic Animation Language," IEEE Computer Graphics & Applications, Sep. 1982, pp. 43-54, vol. 2, No. 7.
Fiume et al., "A Parallel Scan Conversion Algorithm with Anti-Aliasing for a General-Purpose Ultracomputer," Computer Graphics, Jul. 1983, pp. 141-150, vol. 17, No. 3.
Foley et al., Computer Graphics: Principles and Practice, 2nd ed., 1990, Addison-Wesley Publishing Co., Inc., Menlo Park, California.
Foley et al., Fundamentals of Interactive Computer Graphics, 1982, Addison-Wesley Publishing Co., Inc., Menlo Park, California.
Fox et al., "Development of Computer-Generated Imagery for a Low-Cost Real-Time Terrain Imaging System," IEEE 1986 National Aerospace and Electronic Conference, May 19-23, 1986, pp. 986-991.
Gambotto, "Combining Image Analysis and Thermal Models for Infrared Scene Simulations," Image Processing Proceedings, ICIP-94, IEEE International Conference, 1994, vol. 1, pp. 710-714.
Gardiner, "A Method for Rendering Shadows," E&S Company, Sep. 25, 1996.
Gardiner, "Shadows in Harmony," E&S Company, Sep. 20, 1996.
Gardner, "Simulation of Natural Scenes Using Textured Quadric Surfaces," Computer Graphics, Jul. 1984, pp. 11-20, vol. 18, No. 3.
Gardner, "Visual Simulation of Clouds," Siggraph '85, Jul. 22-26, 1985, San Francisco, California, pp. 297-303.
Giloi, Interactive Computer Graphics: Data Structures, Algorithms, Languages, 1978, Prentice-Hall, Inc., Englewood Cliffs, New Jersey.
Glaskowsky, "Intel Displays 740 Graphics Chip: Auburn Sets New Standard for Quality—But Not Speed," Microprocessor Report, Feb. 16, 1998, pp. 5-9, vol. 12, No. 2.
Goshtasby, "Registration of Images with Geometric Distortions," IEEE Transactions on Geoscience and Remote Sensing, Jan. 1988, pp. 60-64, vol. 26, No. 1.
Great Britain Health & Safety Executive, The Radiation Safety of Lasers Used for Display Purposes, Oct. 1996.
Gupta et al., "Filtering Edges for Gray-Scale Displays," Computer Graphics, Aug. 1981, pp. 1-5, vol. 15, No. 3.
Gupta et al., "A VLSI Architecture for Updating Raster-Scan Displays," Computer Graphics, Aug. 1981, pp. 71-78, vol. 15, No. 3.
Hanbury, "The Taming of the Hue, Saturation and Brightness Colour Space," Centre de Morphologie Mathematique, Ecole des Mines de Paris, date unknown, pp. 234-243.
Stevens et al., "The National Simulation Laboratory: The Unifying Tool for Air Traffic Control System Development," Proceedings of the 1991 Winter Simulation Conference, 1991, pp. 741-746.
Stone, High-Performance Computer Architecture, 1987, pp. 278-330, Addison-Wesley Publishing Company, Menlo Park, California.
Tanner et al., "The Clipmap: A Virtual Mipmap," Silicon Graphics Computer Systems; Proceedings of the 25th Annual Conference on Computer Graphics and Interactive Techniques, Jul. 1998.
Tanriverdi et al., "Interacting with Eye Movements in Virtual Environments," CHI Letters, Apr. 2000, pp. 265-272, vol. 2, No. 1.
Texas Instruments, DLP® 3-D HDTV Technology, 2007.
Torborg et al., "Talisman: Commodity Realtime 3D Graphics for the PC," Computer Graphics Proceedings, Annual Conference Series, 1996, pp. 353-363.
Trisnadi, "Hadamard speckle contrast reduction," Optics Letters, 2004, vol. 29, pp. 11-13.
Trisnadi et al "Overview and applications of Grating Light Valve™ based optical write engines for high-speed digital imaging," proceedings of conference "MOEMS Display and Imaging SYstems II," Jan. 2004, vol. 5328, 13 pages.
Whitton, "Memory Design for Raster Graphics Displays," IEEE Computer Graphics & Applications, Mar. 1984, pp. 48-65.
Williams, "Casting Curved Shadows on Curved Surfaces," Computer Graphics Lab, New York Institute of Technology, 1978, pp. 270-274.
Williams, "Pyramidal Parametrics," Computer Graphics, Jul. 1983, pp. 1-11, vol. 17, No. 3.
Willis et al., "A Method for Continuous Adaptive Terrain," Presented at the 1996 IMAGE Conference, Jun. 23-28, 1996.
Woo et al., "A Survey of Shadow Algorithms," IEEE Computer Graphics & Applications, Nov. 1990, pp. 13-32, vol. 10, No. 6.
Wu et al., "A Differential Method for Simultaneous Estimation of Rotation, Change of Scale and Translation," Signal Processing: Image Communication, 1990, pp. 69-80, vol. 2, No. 1.
Youbing et al., "A Fast Algorithm for Large Scale Terrain Walkthrough," CAD/Graphics, Aug. 22-24, 2001, 6 pages.
Apte, "Grating Light Valves for High-Resolution Displays," Ph.D. Dissertation—Stanford University, 1994 (abstract only).
Ellis, "Lo-cost Bimorph Mirrors in Adaptive Optics," Ph.D. Thesis, Imperial College of Science, Technology and Medicine—University of London, 1999.
Halevi, "Bimorph piezoelectric flexible mirror: graphical solution and comparison with experiment," J. Opt. Soc. Am., Jan. 1983, pp. 110-113, vol. 73, No. 1.
Kudryashov et al., "Adaptive Optics for High Power Laser ZBeam Control," Springer Proceedings in Physics, 2005, pp. 237-248, vol. 102.
Safronov, "Bimorph adaptive optics: elements, technology and design principles," SPIE, 1996, pp. 494-504, vol. 2774.
Solgaard, "Integrated Semiconductor Light Modulators for Fiber-Optic and Display Applications," Ph.D. Dissertation submitted to the Deparatment of Electrical Engineering and the Committee on Graduate Studies of Stanford University, Feb. 1992.
Steinhaus et al., "Bimorph piezoelectric flexible mirror," J. Opt. Soc. Am., Mar. 1979, pp. 478-481, vol. 69, No. 3.
Tseng et al., "Development of an Aspherical Bimorph PZT Mirror Bender with Thin Film Resistor Electrode," Advanced Photo Source, Argonne National Laboratory, Sep. 2002, pp. 271-278.
Vinevich et al., "Cooled and uncooled single-channel deformable mirrors for industrial laser systems," Quantum Electronics, 1998, pp. 366-369, vol. 28, No. 4.
Hearn et al., Computer Graphics, 2nd ed., 1994, pp. 143-183.
Heckbert, "Survey of Texture Mapping," IEEE Computer Graphics and Applications, Nov. 1986, pp. 56-67.
Heckbert, "Texture Mapping Polygons in Perspective," New York Institute of Technology, Computer Graphics Lab, Technical Memo No. 13, Apr. 28, 1983.
Heidrich et al., "Applications of Pixel Textures in Visualization and Realistic Image Synthesis," Symposium on INteractive 3D Graphics, 1990, pp. 127-135, Atlanta, Georgia.
Holten-Lund, Design for Scalability in 3D Computer Graphics Architectures, Ph.D. thesis, Computer Science sand Technology Informatics and Mathematical Modelling, Technical University of Denmark, Jul. 2001.
Integrating Sphere, www.crowntech.-inc.com, 010-82781750/82782352/68910917, date unknown.
INTEL740 Graphics Accelerator Datasheet, Apr. 1998.
INTEL470 Graphics Accelerator Datasheet, Architectural Overview, at least as early as Apr. 30, 1998.
Jacob, "Eye Tracking in Advanced Interface Design," ACM, 1995.

Kelley et al., "Hardware Accelerated Rendering of CSG and Transparency," SIGGRAPH'94, in Computer Graphics Proceedings, Annual Conference Series, 1994, pp. 177-184.
Klassen, "Modeling the Effect of the Atmosphere on Light," ACM Transactions on Graphics, Jul. 1987, pp. 215-237, vol. 6, No. 3.
Kleiss, "Tradeoffs Among Types of Scene Detail for Simulating Low-Altitude Flight," University of Dayton Research Institute, Aug. 1, 1992, pp. 1141-1146.
Lewis, "Algorithms for Solid Noise Synthesis," SIGGRAPH '89, Computer Graphics, Jul. 1989, pp. 263-270, vol. 23, No. 3.
Lindstrom et al., "Real-Time, Continuous Level of Detail Rendering of Height Fields," SIGGRAPH'96, Aug. 1996.
McCarty et al., "A Virtual Cockpit for a Distributed Interactive Simulation," IEEE Computer Graphics & Applications, Jan. 1994, pp. 49-54.
Microsoft Flight Simulator 2004, Aug. 9, 2000. http://www.microsoft.com/games/flightsimulator/fs2000_devdesk.sdk.asp.
Miller et al., "Illumination and Reflection Maps: Simulated Objects in Simulated and Real Environments," SIGGRAPH'84, Course Notes for Advances Computer Graphics Animation, Jul. 23, 1984.
Mitchell, "Spectrally Optimal Sampling for Distribution Ray Tracing," SIGGRAPH'91, Computer Graphics, Jul. 1991, pp. 157-165, vol. 25, No. 4.
Mitsubishi Electronic Device Group, "Overview of 3D-RAM and Its Functional Blocks," 1995.
Montrym et al., "InfiniteReality: A Real-Time Graphics System," Computer Graphics Proceedings, Annual Conference Series, 1997.
Mooradian et al., "High Power Extended Vertical Cavity Surface Emitting Diode Lasers and Arrays and Their Applications," Micro-Optics Conference, Tokyo, Nov. 2, 2005.
Musgrave et al., "The Synthesis and Rendering of Eroded Fractal Terrains," SIGGRAPH '89, Computer Graphics, Jul. 1989, pp. 41-50, vol. 23, No. 3.
Nakamae et al., "Compositing 3D Images with Antialiasing and Various Shading Effects," IEEE Computer Graphics & Applications, Mar. 1989, pp. 21-29, vol. 9, No. 2.
Newman et al., Principles of Interactive Computer Graphics, 2nd ed., 1979, McGraw-Hill Book Company, San Francisco, California.
Niven, "Trends in Laser Light Sources for Projection Display," Novalux International Display Workshop, Session LAD2-2, Dec. 2006.
Oshima et al., "An Animation Design Tool Utilizing Texture," International Workshop on Industrial Applications of Machine Intelligence and Vision, Tokyo, Apr. 10-12, 1989, pp. 337-342.
Parke, "Simulation and Expected Performance Analysis of Multiple Processor Z-Buffer Systems," Computer Graphics, 1980, pp. 48-56.
Peachey, "Solid Texturing of Complex Surfaces," SIGGRAPH '85, 1985, pp. 279-286, vol. 19, No. 3.
Peercy et al., "Efficient Bump Mapping Hardware," Computer Graphics Proceedings, 1997.
Perlin, "An Image Synthesizer," SIGGRAPH '85, 1985, pp. 287-296, vol. 19, No. 3.
Pineda, "A Parallel Algorithm for Polygon Rasterization," SIGGRAPH '88, Aug. 1988, pp. 17-20, vol. 22, No. 4.
Polis et al., "Automating the Construction of Large Scale Virtual Worlds," Digital Mapping Laboratory, School of Computer Science, Carnegie Mellon University, date unknown.
Porter et al., "Compositing Digital Images," SIGGRAPH '84, Computer Graphics, Jul. 1984, pp. 253-259, vol. 18, No. 3.
Poulton et al., "Breaking the Frame-Buffer Bottleneck with Logic-Enhanced Memories," IEEE Computer Graphics & Applications, Nov. 1992, pp. 65-74.
Rabinovich et al., "Visualization of Large Terrains in Resource-Limited Computing Environments," Computer Science Department, Technion—Israel Institute of Technology, pp. 95-102, date unknown.
Reeves et al., "Rendering Antialiased Shadows with Depth Maps," SIGGRAPH '87, Computer Graphics, Jul. 1987, pp. 283-291, vol. 21, No. 4.
Regan et al., "Priority Rendering with a Virtual Reality Address Recalculation Pipeline," Computer Graphics Proceedings, Annual Conference Series, 1994.
Rhoades et al., "Real-Time Procedural Textures," ACM, Jun. 1992, pp. 95-100, 225.
Rockwood et al., "Blending Surfaces in Solid Modeling," Geometric Modeling: Algorithms and New Trends, 1987, pp. 367-383, Society for Industrial and Applied Mathematics, Philadelphia, Pennsylvania.
Röttger et al., "Real-Time Generation of Continuous Levels of Detail for Height Fields," WSCG '98, 1998.
Saha et al., "Web-based Distributed VLSI Design," IEEE, 1997, pp. 449-454.
Salzman et al., "VR's Frames of Reference: A Visualization Technique for Mastering Abstract Multidimensional Information," CHI 99 Papers, May 1999, pp. 489-495.
Sandejas, Silicon Microfabrication of Grating Light Valves, Doctor of Philosophy Dissertation, Stanford University, Jul. 1995.
Scarlatos, "A Refined Triangulation Hierarchy for Multiple Levels of Terrain Detail," presented at the Image V Conference, Phoenix, Arizona, Jun. 19-22, 1990, pp. 114-122.
Schilling, "A New Simple and Efficient Antialiasing with Subpixel Masks," SIGGRAPH '91, Computer Graphics, Jul. 1991, pp. 133-141, vol. 25, No. 4.
Schumacker, "A New Visual System Architecture," Proceedings of the Second Interservices/Industry Training Equipment Conference, Nov. 18-20, 1990, Salt Lake City, Utah.
Segal et al., "Fast Shadows and Lighting Effects Using Texture Mapping," SIGGRAPH '92, Computer Graphics, Jul. 1992, pp. 249-252, vol. 26, No. 2.
Sick AG, S3000 Safety Laser Scanner Operating Instructions, Aug. 25, 2005.
Silicon Light Machines, "White Paper: Calculating Response Characteristics for the 'Janis' GLV Module, Revision 2.0," Oct. 1999.
Sollberger et al., "Frequency Stabilization of Semiconductor Lasers for Applications in Coherent Communication Systems," Journal of Lightwave Technology, Apr. 1987, pp. 485-491, vol. LT-5, No. 4.

* cited by examiner

CALIBRATION SYSTEM AND METHOD FOR LIGHT MODULATION DEVICE

CROSS-REFERENCE TO RELATED APPLICATIONS

This application claims the benefit of U.S. Provisional Application No. 61/113,977, filed, Nov. 12, 2008, entitled "Calibration System and Method for Light Modulation Device," which is hereby incorporated by reference herein in its entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND

1. The Field of the Invention.

The present disclosure relates generally to light modulation devices, and more particularly, but not necessarily entirely, to methods of calibrating light modulation devices.

2. Description of Background Art

A wide variety of devices exist for modulating a beam of incident light. Light modulating devices may be suitable for use in displaying images. One type of light modulating device, known as a grating light modulator, includes a plurality of reflective and deformable ribbons suspended over a substrate. The ribbons are parallel to one another and are arranged in rows and may be deflected, i.e., pulled down, by applying a bias voltage between the ribbons and the substrate. A first group of ribbons may comprise alternate rows of the ribbons. The ribbons of the first group may be collectively driven by a single digital-to-analog controller ("DAC") such that a common bias voltage may be applied to each of them at the same time. For this reason, the ribbons of the first group are sometimes referred to herein as "bias ribbons." A second group of ribbons may comprise those alternate rows of ribbons that are not part of the first group. Each of the ribbons of the second group may be individually controllable by its own dedicated DAC such that a variable bias voltage may be independently applied to each of them. For this reason, the ribbons of the second group are sometimes referred to herein as "active ribbons."

The bias and active ribbons may be sub-divided into separately controllable picture elements referred to herein as "pixels." Each pixel contains, at a minimum, a bias ribbon and an adjacent active ribbon. When the reflective surfaces of the bias and active ribbons of a pixel are co-planar, essentially all of the incident light directed onto the pixel is reflected. By blocking the reflected light from a pixel, a dark spot is produced on the display. When the reflective surfaces of the bias and active ribbons of a pixel are not in the same plane, incident light is diffracted off of the ribbons. Unblocked, this diffracted light produces a bright spot on the display. The intensity of the light produced on a display by a pixel may be controlled by varying the separation between the reflective surfaces of its active and bias ribbons. Typically, this is accomplished by varying the voltage applied to the active ribbon while holding the bias ribbon at a common bias voltage.

The contrast ratio of a pixel is the ratio of the luminosity of the brightest output of the pixel and the darkest output of the pixel. It has been previously determined that the maximum light intensity output for a pixel will occur in a diffraction based system when the distance between the reflective surfaces its active and bias ribbons is $\lambda/4$, where $\lambda$ is the wavelength of the light incident on the pixel. The minimum light intensity output for a pixel will occur when the reflective surfaces of its active and bias ribbons are co-planar. Intermediate light intensities may be output from the pixel by varying the separation between the reflected surfaces of the active and bias ribbons between co-planar and $\lambda/4$. Additional information regarding the operation of grating light modulators is disclosed in U.S. Pat. Nos. 5,661,592, 5,982,553, and 5,841,579, which are all hereby incorporated by reference herein in their entireties.

As previously mentioned, all of the bias ribbons are commonly controlled by a single DAC and each of the active ribbons is individually controlled by its own dedicated DAC. Each DAC applies an output voltage to its controlled ribbon or ribbons in response to an input signal. Ideally, each DAC would apply the same output voltage in response to the same input signal. However, in practice, it is very difficult to perfectly match the gain and offset of all the DACs to the degree of accuracy that is required for optimum operation of a light modulator due to the differences in the individual operating characteristics of each DAC. Thus, disadvantageously, the same input values may not always result in the same output for different DACs. This discrepancy means that two active ribbons whose DACs receive the same input signal may be undesirably deflected in different amounts thereby making it difficult to display an image with the proper light intensities.

In view of the foregoing, it is understood that prior to use the combination of DACs and ribbons on a light modulating device must be calibrated to ensure that the desired light intensities are correctly reproduced in a displayed image. As mentioned, calibration is required due to the fact that the offset voltage and gain of each DAC may be different. Thus, given the same DAC input values for the active ribbons of two pixels, the displayed light intensities generated by the two pixels will likely be different because the active ribbons will be deflected in different amounts. Calibration is intended to ensure that the different operational characteristics of the DACs and ribbons are taken into account during operation of the light modulation device.

The calibration process may be divided into two separate calibration processes, namely, a dark-state calibration and a bright-state calibration. Generally speaking, the dark-state calibration is an attempt to determine the DAC input values at which the pixels produce the minimum amount of light possible and the bright-state calibration is an attempt to ensure that each pixel produces the same light intensity for the same source input values.

Prior to the present disclosure, known calibration techniques for light modulation devices did not always produce the best possible results. In particular, previously known dark-state calibration methods involved calibrating all of the pixels on a light modulating device at the same time using a group-calibration process. For example, using one previously available dark-state calibration process, all of the DACs for the active ribbons of a light modulation device were first set with an input value of 0. (However, due to the offset of each of the active ribbons' DAC, a small voltage of about 0.5 volts was actually applied to the active ribbons thereby pulling them slightly down.) Then, the input value to the single DAC controlling all of the bias ribbons was experimentally varied until the best overall dark state for all of the pixels was determined by visual inspection from a human. As a result of the above described group-calibration process for the dark state, the constituent ribbons of some of the pixels were not necessarily co-planar as is required for the minimum light intensity output. Thus, some of the pixels still produced some light output even when they were set to a dark state.

The previously available bright-state calibration processes used a brute force method to determine the correct input value for a DAC based upon a desired intensity level. In particular, the previous bright-state calibration methods used an 8-entry look-up-table ("LUT") to store the DAC input value to use for each individual pixel (DAC values were interpolated for intensities in between). The desired DAC value for each of the 8 LUT intensities was found by performing a binary search on DAC values until the desired intensity was reached. This search was performed on each pixel for each of the 8 LUT entries. One drawback to this method is that it took over 8 hours to calibrate a light modulation device with just 1000 pixels.

In view of the foregoing, it would therefore be an improvement over the previously available calibration methods to provide a dark-state calibration that minimizes the light output of each pixel individually instead of on a collective basis. It would further be an improvement over the previously available dark-state calibration methods to provide an alternative to using visual inspection by a human to determine a minimum light intensity output. It would further be an improvement over the previously available bright-state calibration methods to provide a bright-state calibration method that is quicker and easier to implement for a light modulating device with a high number of pixels.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
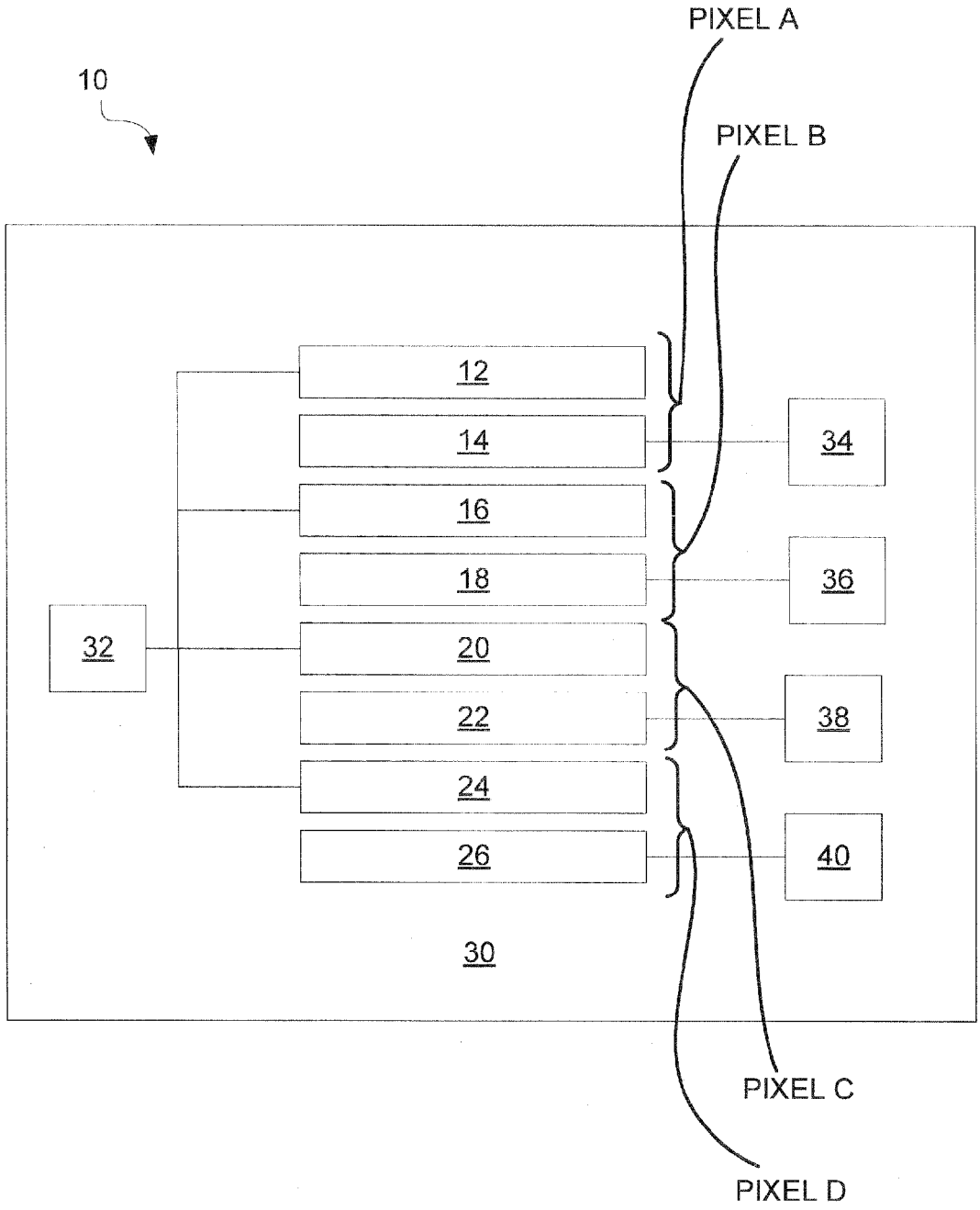
FIG. 1 depicts a light modulation device having a plurality of deflectable ribbons.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Referring now to FIG. 1, there is depicted a light modulation device 10 having a plurality of ribbons 12-26 arranged in a one-dimensional array on a substrate 30. The ribbons 12-26 may be formed from a layer of silicon nitride using an etching process such that the ribbons 12-26 are suspended above the substrate 30. In particular, a gap may separate the ribbons 12-26 from the substrate 30.

Each of the ribbons 12-26 may include a reflective coating, such as an aluminum coating, on the top surface visible in FIG. 1. The substrate 30 may include a conductive material beneath all of the ribbons 12-26 such that a voltage difference may be applied between the ribbons 12-26 and the substrate 30. Further, the reflective coating on the ribbons 12-26 may be conductive such that a voltage difference may be applied between the ribbons 12-26 and the corresponding locations on the substrate 30.

A first group of ribbons may begin with ribbon 12 and include every second or alternate ribbon below it, namely ribbons 16, 20 and 24. For purposes of convenience, the ribbons of the first group will be referred to herein as "bias ribbons." A second group of ribbons may begin with ribbon 14 and include every second or alternate ribbon below it, namely ribbons 18, 22 and 26. For purposes of convenience, the ribbons of the second group will be referred to herein as "active ribbons."

The bias ribbons may be electrically connected to, and commonly controlled by, a DAC 32. The active ribbons may each be electrically connected to, and controlled by, a dedicated DAC. In particular, ribbons 14, 18, 22 and 26 are individually controlled by DACs 34, 36, 38 and 40, respectively. The DACs 32-40 may accept input values corresponding to a 16-bit architecture, such that the input values may have a range between 0 and 65535. In response to an input value, each of the DACs 32-40 may produce an output voltage which is applied to the ribbon or ribbons controlled by it. It will be further appreciated that the DACs 32-40 may be considered control devices as they control the amount of deflection of each of the ribbon or ribbons to which they are connected.

The ribbons 12-26 may be subdivided into separately controllable picture elements, or pixels. As used herein, the term "pixel" may refer to a combination of micro-electro-mechanical ("MEMS") elements on a light modulation device that are able to modulate incident light to form a corresponding display pixel on a viewing surface. (The term "display pixel" referring to a spot of light on a viewing surface that forms part of a perceived image.) Each of the pixels on a light modulation device may determine, for example, the light intensity of one or more parts of an image projected onto a display. In a display system using a scan-based architecture, a pixel on a light modulation device may be responsible for forming an entire linear element of an image across a display, such as a row.

Each of the pixels on the light modulation device 10 may comprise, at a minimum, one bias ribbon and an adjacent active ribbon. In FIG. 1, then, the ribbons 12 and 14 form Pixel A, the ribbons 16 and 18 form Pixel B, the ribbons 20 and 22 form Pixel C, and the ribbons 24 and 26 form Pixel D. It will be appreciated that the number of pixels of the light modulation device 10 is exemplary only, and that, in an actual application, the number of pixels on the light modulation device 10 may exceed several hundred, or even several thousand, to obtain the desired resolution of the displayed image. In addition, it will be appreciated that a pixel may comprise more than one bias ribbon and more than one active ribbon.

During operation, a common bias voltage is applied, and maintained, between the bias ribbons and the substrate 30 by the DAC 32. The appropriate active ribbon of each of the pixels may then be individually controlled to thereby determine a light intensity output. As previously discussed, incident light will be reflected from a pixel when the reflective surfaces of its constituent bias and active ribbons are both co-planar. In a display system that blocks reflected light, a pixel's light intensity output will be at a minimum value, sometimes referred to herein as a "dark state," when the reflective surfaces of its constituent bias and active ribbons are co-planar.

A pixel's light intensity output may be increased from its dark state by deforming the pixel's active ribbon from its co-planar relationship with the bias ribbon. It has been previously determined that the maximum light intensity output for a pixel will occur in a diffraction based system when the distance between the reflective surfaces of the bias ribbon and the active ribbon is $\lambda/4$, where $\lambda$ is the wavelength of the light incident on the pixel. Intermediate light intensity outputs may be achieved by varying the distance between the reflective surfaces of the bias ribbon and the active ribbon in a range from 0, i.e., co-planar, to $\lambda/4$.

Calibration of the pixels of the light modulation device 10 according to the present disclosure may be broken down into a dark-state calibration and a bright-state calibration. One purpose of the dark-state calibration is to determine each active ribbon's DAC input value that will result in the minimum light intensity output for each pixel. One purpose of the bright-state calibration is to be able to accurately predict a light intensity output for each pixel for any given DAC input value.

Figure 2:
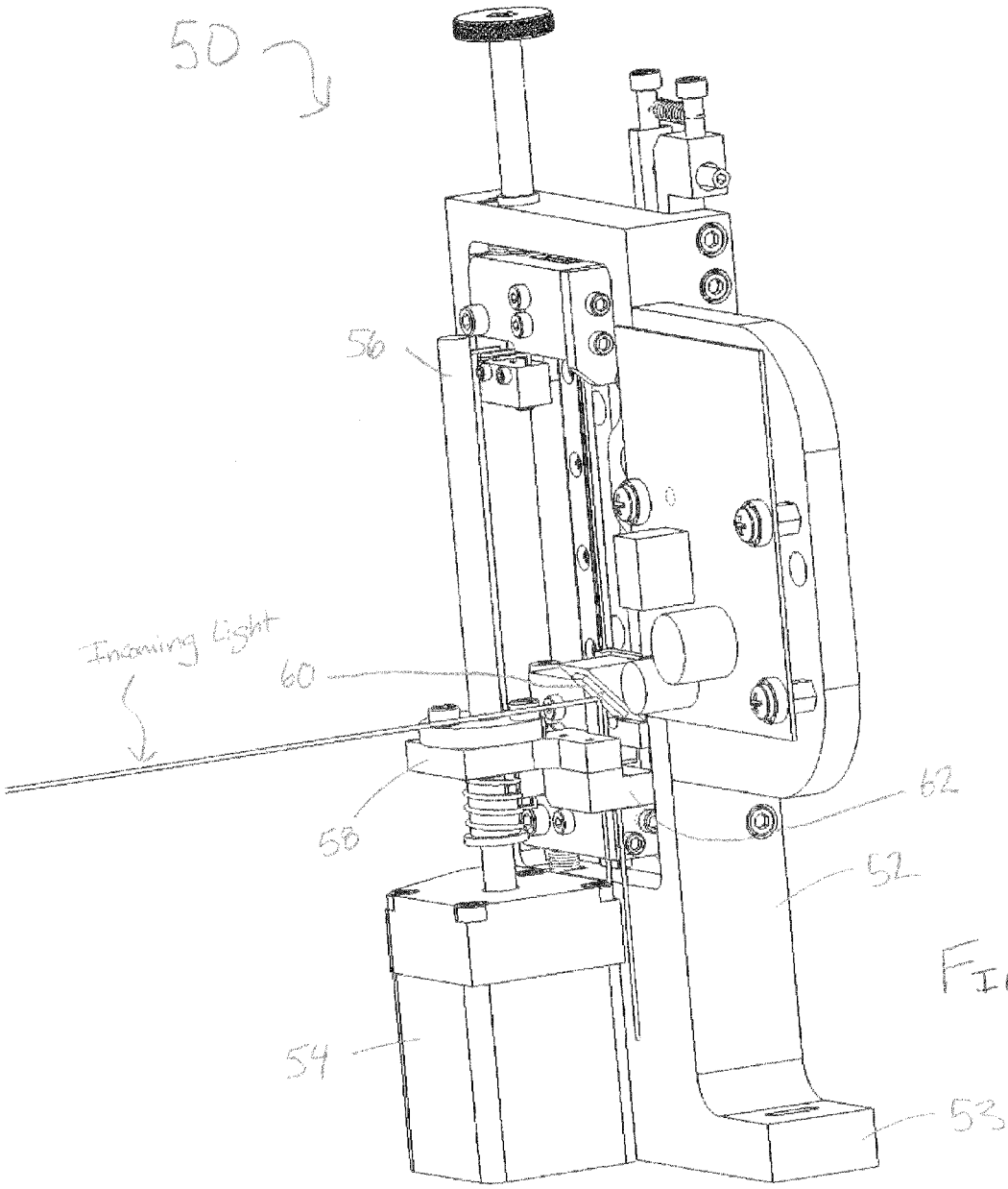
FIG. 2 is a perspective view of a light detection device with a photodetector.

Referring now to FIG. 2, there is depicted a detection device 50 for use in calibrating the light modulation device 10 (FIG. 1). The detection device 50 may include a support structure 52 and a mounting base 53. Mounted to the support structure 52 may be a stepper motor 54 having an output shaft 56. A moveable stage 58 may be mounted to the output shaft 56 of the stepper motor 54. The stage 58 may move up and down along the shaft 56 of the stepper motor 54. Mounted to the stage 58 is a reflective surface 60 for directing incoming light onto a photodetector 62. A slit (not visible) in front of the photodetector 62 may only allow light from a predetermined number of pixels to hit the photodetector 62 at any given time.

In one embodiment of the present disclosure, the slit is approximately 200 μm and may allow light from approximately 30 to 80 pixels to hit the photodetector 62 at a given time. The detection device 50 is placed in the path of diffracted light from the light modulation device 10 such that the stage 58 may accurately center light from any given pixel onto the photodetector 62. The stepper motor 54 may move the stage 58 along the shaft 56 as needed to calibrate any pixel of the light modulation device 10. In particular, the stepper motor 54 positions the photodetector 62 in an optical output path of a desired pixel.

An output signal from the photodetector 62 is received by a lock-in amplifier circuit (not explicitly labeled). The lock-in amplifier circuit may work at a frequency of approximately 10 KHz to filter out any unwanted noise, as is known to one of ordinary skill in the art. In particular, a pixel being calibrated may have its active ribbon toggled between the desired DAC input value and a reference DAC value of 0 (or a DAC input value that makes the pixel's output as dark as possible) at a frequency of 10 KHz. The lock-in amplifier is operable to measure the amplitude of this 10 KHz signal, which happens to be the light intensity corresponding to the input DAC value. When the DAC toggles the active ribbon of a pixel from the reference value of 0 to the desired DAC value, the photodetector 62 measures the intensity of the pixel at the desired DAC value along with the dark state intensity of the other pixels whose light is not filtered by the slit. However, since the lock-in amplifier only measures changes having a frequency of 10 KHz, the resulting signal is the difference in intensity between the desired DAC value and the reference value. It will be appreciated that the intensity from the other pixels whose light is allowed to pass through the slit is filtered out along with any other noise that is not related to the toggling of the pixel being measured since none of the ribbons of the other pixels are being toggled. It will be further appreciated that the use of a lock-in amplifier allows the intensity of a desired pixel to be measured without having to mechanically single out the desired pixel from the other pixels whose light is allowed to pass through the slit in front of the photodetector 62.

Still referring to FIG. 2, the first step to calibrate the light modulation device 10 (as represented in FIG. 1) is to place the detection device 50 into the diffracted light path from the light modulation device 10. This may be at a point to capture an intermediate image. The next step is to relate the position of each of the pixels of the light modulation device 10 with the position of the stepper motor 54 by briefly toggling the pixels one by one while moving the stage 58 through the beam of diffracted light. This step allows the photodetector 62 to be accurately centered up with each pixel on the light modulation device 10.

In an embodiment of the present disclosure, the position of each of the pixels of the light modulation device 10 in relation to the position of the stepper motor 54 may be determined by toggling less than all of the pixels and then determining the position of the other pixels by liner interpolation. Once the above recited steps are complete, each of the Pixels A-D (as represented in FIG. 1) may be calibrated for a dark state and a bright state as will be described below. In an embodiment of the present disclosure, not all of the Pixels A-D are calibrated and their dark state may be found through mathematical calculation (linear interpolation).

Dark-State Calibration

Figure 3:
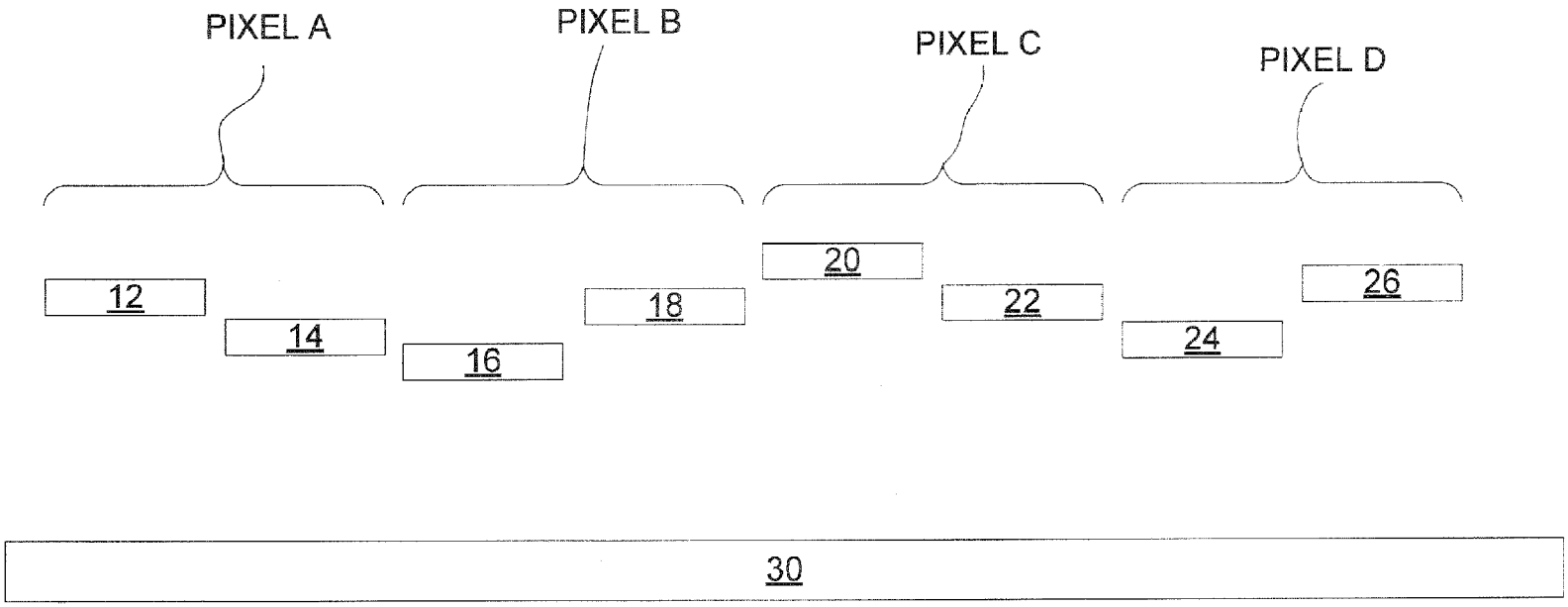
FIG. 3 depicts a cross-sectional view of the ribbons on the light modulation device shown in FIG. 1 in an uncalibrated and unbiased state.

Referring now to FIG. 3, there is shown the ribbons 12-26 (which are also represented in FIG. 1) in an uncalibrated and undeflected state above the substrate 30. The ribbons 12-26 are held in this uncalibrated and undeflected state due to the natural tensile strength of the ribbons 12-26 and due to differences in DAC offset voltages. It will be noted that the bias ribbons 12 and 20 are positioned above their adjacent active ribbons 14 and 22, respectively, while the bias ribbons 16 and 24 are positioned below their adjacent active ribbons 18 and 26, respectively.

Figure 4:
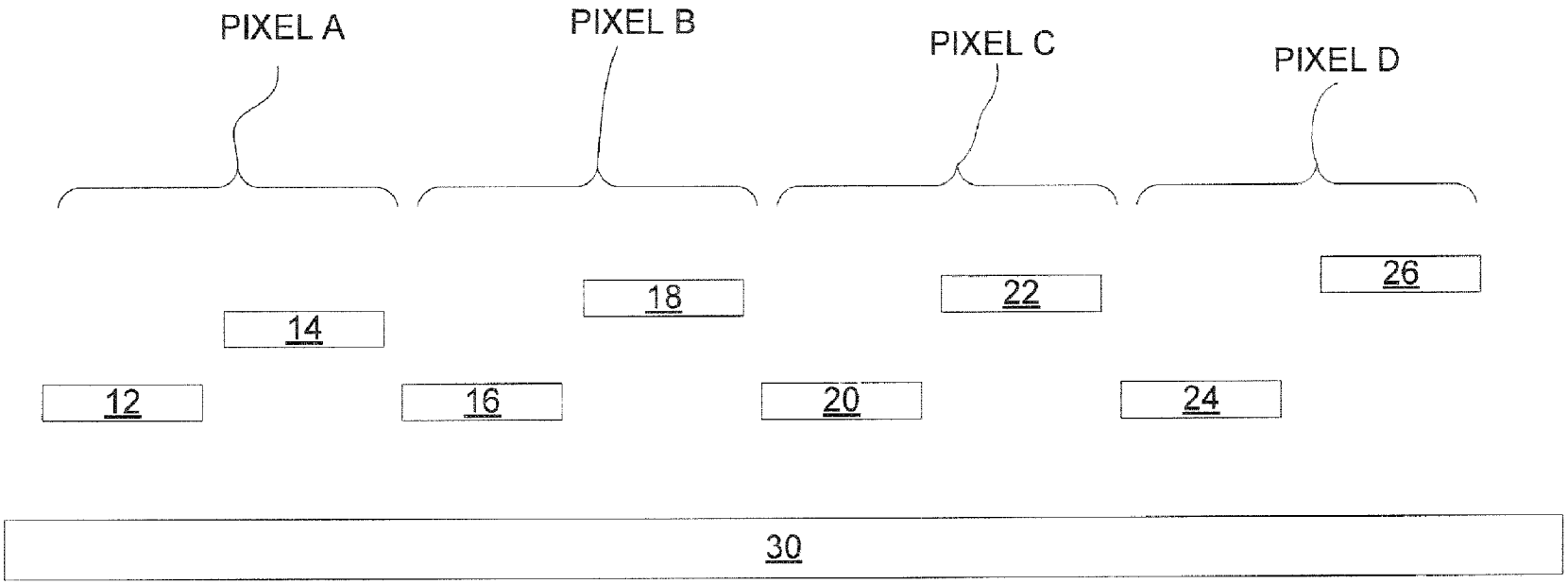
FIG. 4 depicts a cross-sectional view of the ribbons on the light modulation device shown in FIG. 1 with the bias ribbons pulled down.

The first step of the dark-state calibration method according to the present disclosure is to apply a common bias voltage to all of the bias ribbons 12, 16, 20 and 24 such that each of them is deflected to a common biased position as shown in FIG. 4. The common biased position is characterized by the fact that it is below the reflective surfaces of all of the active ribbons 14, 18, 22 and 24. It will be noted that the bias ribbons 12, 14, 20, and 24 are maintained at the common biased position during calibration and operation of the light modulation device 10. Once the bias ribbons 12, 16, 20 and 24 have been deflected to the common biased position, a dark state for each pixel can then be determined. In an embodiment of the present disclosure, the position of each of the bias ribbons 12, 14, 20, and 24 when deflected to the common biased position may be slightly different.

The dark-state calibration of Pixel A, comprising the bias ribbon 12 and the active ribbon 14, will now be described. Again, the purpose of the dark-state calibration is to determine the input value for DAC 34 (FIG. 1) at which the active ribbon 14 is deflected in an amount such that the reflective surfaces of the bias ribbon 12, at the common bias position, and the active ribbon 14 are substantially co-planar. To find the input value for DAC 34 that produces the minimum intensity or dark state of Pixel A, the intensity output of the Pixel A is measured at several predetermined input values for the DAC 34 using the detection device 50 (FIG. 2).

As the input values for the DAC 34 are successively increased, the light output intensity of the Pixel A will decrease up until the point that the reflective surface of the active ribbon 14 is co-planar with the reflective surface of the bias ribbon 12. As the input values for the DAC 34 are increased past the input value at which the active ribbon 14 and the bias ribbon 12 are co-planar, the intensity of the Pixel A will begin increasing again since the active ribbon 14 will be deflected past the bias ribbon 12.

Figure 5:
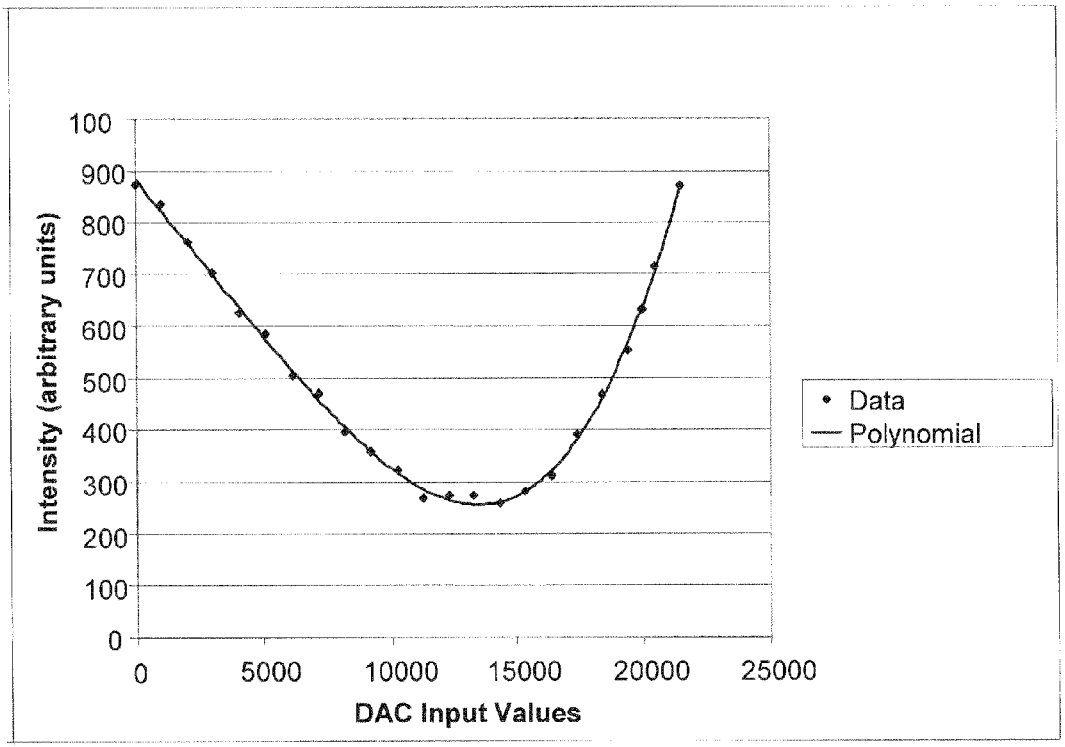
FIG. 5 is a graph of a dark-state curve for a pixel on the light modulation device shown in FIG. 1.

The predetermined input values for the DAC 34 and the corresponding light intensity outputs of the Pixel A may form a set of data points that may be graphed as shown in FIG. 5, where the input values for the DAC 34 are plotted along the x-axis and their corresponding intensity output levels are plotted along the y-axis. Using the data points in the graph shown in FIG. 5, any suitable curve fitting technique may be employed to find a curve that has the best fit to the data points.

In an embodiment of the present disclosure, a $4^{th}$ order polynomial curve fit may be performed using the data points to create a curve that describes the intensity response of Pixel A with respect to the input values. This $4^{th}$ order polynomial may take the form of Equation 1, $$I_D(V)=AV^4+BV^3+CV^2+DV+E$$

where $I_D(V)$ is equal to the light output intensity of Pixel A determined experimentally and V is equal to the voltage applied to the active ribbon 14 by DAC 34. (In order to use Equation 1, it is assumed that DAC 34 has a linear response so that one can easily convert the DAC input value to voltage or from voltage to the DAC input value.) The unknowns of Equation 1, namely variables A, B, C, D, and E, may be found using any suitable technique. In an embodiment of the present disclosure, the unknown variables A, B, C, D, and E may be determined by using the method of least squares. The resulting equation determined from the data points on the graph shown in FIG. 5 is sometimes referred to herein as the "dark-state equation" of Pixel A.

Once determined, the dark-state equation for Pixel A may then be used to determine the input value for the DAC 34 that produces the minimum intensity or dark state for the Pixel A. This point is where the intensity of the Pixel A is at a minimum as seen on the graph in FIG. 5. Thus, to reproduce the dark state of the Pixel A during operation of the light modulation device 10, one simply sets the input value to DAC 34 that corresponds to the minimum intensity as determined by the dark-state curve and the dark-state equation. The above described dark-state calibration process is then repeated individually for each of the remaining Pixels B, C and D of the light modulation device 10. Thus, each pixel on the light modulation device 10 will have its own unique dark-state curve and corresponding dark-state equation.

The dark-state calibration process pursuant to the present disclosure may start with the topmost pixel on the light modulation device 10, i.e., Pixel A, and continue in a sequential order until the bottommost pixel on the light modulation device 10, i.e., Pixel D, is calibrated. After a pixel's dark state has been determined through the above described process, the pixel should be left in this dark state while the other pixels on the light modulation device 10 are being calibrated. In this manner, all of the neighboring pixels above the pixel actually being calibrated are at their best available dark state.

For those pixels below the pixel being calibrated on the light modulation device 10, they may be set to their best known dark-states if such data is available. If no such data is available, then an estimated dark-state value may be used. The estimated dark-state value may be determined by performing a dark-state calibration on a group of neighboring and uncalibrated pixels below the pixel actually being calibrated. This group dark-state calibration involves moving all of the active ribbons of the group of neighboring and uncalibrated pixels at the same time and determining an estimated DAC input value that will result in a minimum intensity of the group as a whole. Once determined, each of the DACs of the active ribbons in the group of uncalibrated pixels is set to this estimated DAC input value.

The group of neighboring and uncalibrated pixels may comprise about 80 pixels beneath the pixel actually being calibrated. This group calibration may be repeated about every 20 pixels so that there are always at least 60 pixels below the pixel actually being calibrated that are set to the estimated DAC input value that produces a minimum intensity for the group as a whole. It will be appreciated that the use of the group dark-state estimation of the neighboring and uncalibrated pixels as explained above allows for a better solution than if the active ribbons of the neighboring and uncalibrated pixels were left at arbitrary positions.

Figure 6:
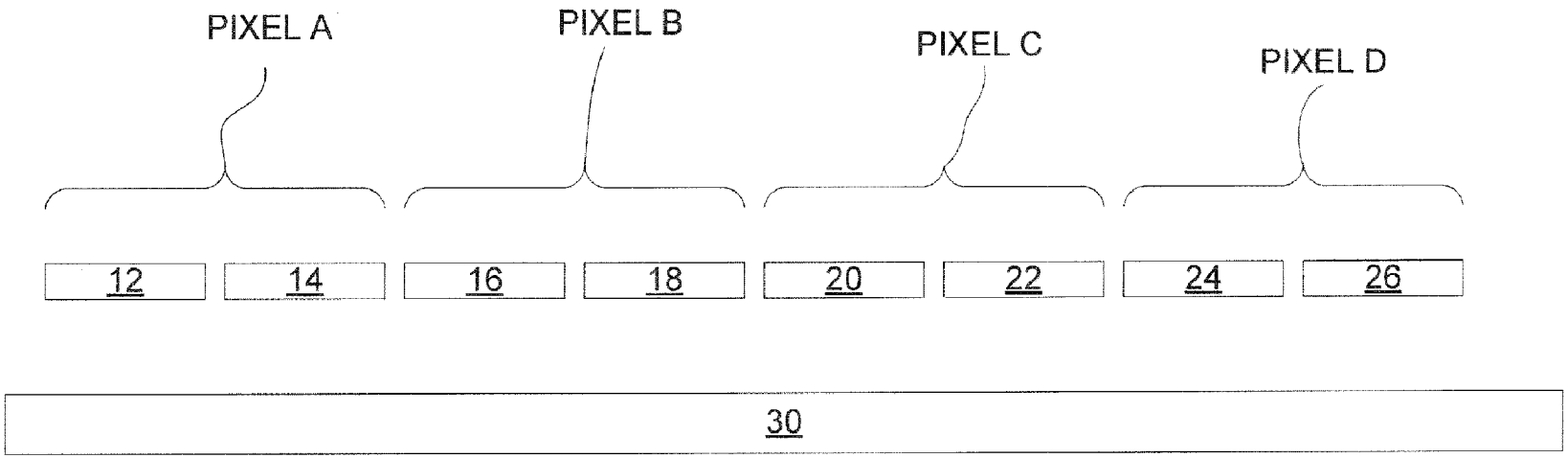
FIG. 6 depicts a cross-sectional view of the ribbons on the light modulation device shown in FIG. 1 in a dark state configuration.

Further, due to the fact that a pixel's own dark-state calibration may be affected by the subsequent dark-state calibration of adjacent pixels, the above described calibration process may need to be repeated at least twice for the Pixels A-D on the light modulation device 10 using an iterative calibration process. The end result of the dark-state calibration process should allow the active ribbon and bias ribbon of each pixel to be positioned such that they are substantially co-planar as shown in FIG. 6 using the appropriate input value as determined by the pixel's dark-state curve and dark-state equation. It will therefore be appreciated that a dark-state curve fitting process is undertaken for the light modulation device 10 on a pixel-by-pixel basis.

In addition to predicting a DAC input value that produces a minimum light intensity output for each pixel, each pixel's dark-state equation may also be used to predict a light intensity output of the pixel for any DAC input value that falls near the DAC input value that produces the minimum light intensity output for that pixel. Typically, the dark-state equation is used to predict a pixel's intensity output for input values falling in the lower end of the full range of acceptable DAC input values. For example, the dark-state equation may be used for DAC input values falling in a range between 0 and X, where X is a predetermined upper limit for using the dark-state equation.

The exact DAC input value chosen for X is dictated by the dark-state curve. The DAC input value chosen for X must be past the DAC input value that produces the minimum light intensity output or dark state. Also, the DAC input value of X must produce an intensity output that is bright enough that an accurate measurement can be obtained when measuring the bright state with low gains as will be described hereinafter. In a system using a 16-bit architecture, an acceptable value for X has experimentally been determined to be about 20,000. For DAC input values above X, a bright-state equation may be used instead of a dark-state equation as explained below.

Bright-State Calibration

The bright-state calibration according to the present disclosure may be based upon the electro-optic response for a ribbon, which can be modeled by the following Equation 2, $$I_B(V) = C\left(\sin^2\left(-\frac{2\pi}{\lambda} * 0.4y_0\left[\left[1-\left(\frac{(V * V_{gain}) - V_{offset} - V_{BC}}{V_2}\right)^2\right]^{0.44} - 1\right]\right) + I_{Offset}\right)$$

where $I_B(V)$ is the intensity of a pixel whose active ribbon is at voltage V; V is the voltage applied to the active ribbon of the pixel; λ is the wavelength of light incident on the pixel, $V_{BC}$ is the voltage difference between the bias ribbons and the substrate (common); $V_{gain}$ is used to account for the fact that the precise value of V is unknown; $V_{offset}$ is the offset voltage of the active ribbon; $I_{offset}$ is simply a variable to shift the curve created by Equation 1 up or down; $V_2$ is the snap-down voltage of the ribbons; and C is a maximum intensity of the pixel. The other variable, $y_0$, is a fitting parameter.

The variables $I_B(V)$, V, λ, and $V_{BC}$ are the known variables of Equation 2. In particular, $I_B(V)$ can be determined experimentally using the detection device 50. Although V is not known precisely, it can be estimated based upon the DAC input value (0-65535 for a 16-bit system) and based upon the assumption that the output voltage, V, is a linear ramp corresponding to the input values. λ is the wavelength of the source light and $V_{BC}$ is programmed via the DAC 32 for the bias ribbons. Equation 2, therefore, has six unknowns, namely, C, $y_0$, $V_{gain}$, $V_{offset}$, $V_2$, and $I_{offset}$.

Figure 7:
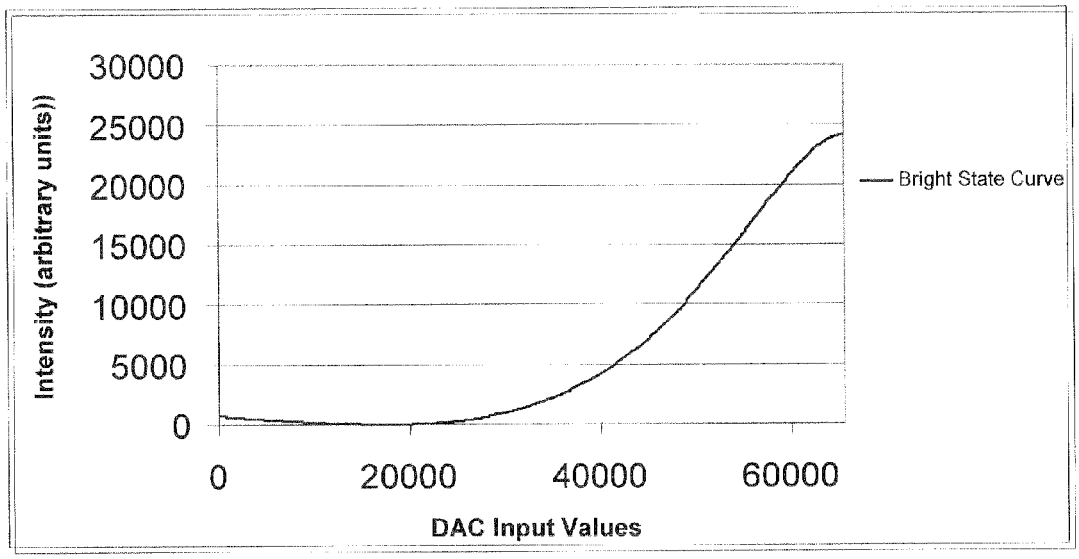
FIG. 7 is a graph of a bright-state curve for a pixel on the light modulation device shown in FIG. 1.

To determine the unknown variables of Equation 2 for a given pixel, say Pixel A, a bright-state curve, such as the one shown in FIG. 7, is built by measuring the intensity output, $I_B(V)$, for a set of predetermined DAC input values. The predetermined DAC input values may range from approximately X, the upper limit of the range for the dark-state equation, to the maximum DAC input value for the Pixel A, e.g., 65535 in a 16-bit system. Once these data points have been measured, any suitable mathematical technique may be utilized to solve for the unknowns in Equation 2 to determine a unique bright-state equation for the Pixel A.

In an embodiment of the present disclosure, a Levenberg-Marquardt type algorithm, or any other iterative algorithm, may be utilized to solve for the unknowns in Equation 2. Suitable starting values of the unknown variables of Equation 2 have been found to be as follows: C=Maximum intensity of the measured data points; $y_0$=600; $V_{gain}$=1.0; $V_{offset}$=0.5; $V_2$=15; and $I_{offset}$=0. Once the unknowns of Equation 2 have been determined for Pixel A, Equation 2 may be utilized to predict the intensity output for any given DAC input value from X to the maximum DAC input value. It will be appreciated that a unique bright-state equation, and bright-state curve, is determined for each of the Pixels A-D on the light modulation device 10.

Combined Dark and Bright State Response

Once a bright-state equation and a dark-state equation have been determined for each of the Pixels A-D, the two equations, or curves, for each pixel can be combined such that the intensity output of the pixel can be predicted for any DAC input value. The process of combining the two equations first involves normalizing the dark-state equation for each pixel.

To normalize the dark-state equation for a given pixel, the minimum intensity of the pixel is set to a value of zero, and the intensity output at the DAC input value of X is normalized to a value of 1.0. This may be accomplished by first subtracting the minimum value of the dark state curve from the variable E to determine a new value, E', (this will shift the minimum of the dark state curve to zero) and then dividing each of the values determined for variables A, B, C, D, and E' of Equation 1 by $I_D(X)$ such that the resulting curve has a minimum intensity output of 0 and a maximum intensity of 1.0 at the DAC input value of X. To combine the dark-state and bright-state equations, the normalized values for variables A, B, C, D, and E' are multiplied by the intensity of the bright-state curve at X as determined by $I_B(X)$.

Figure 8:
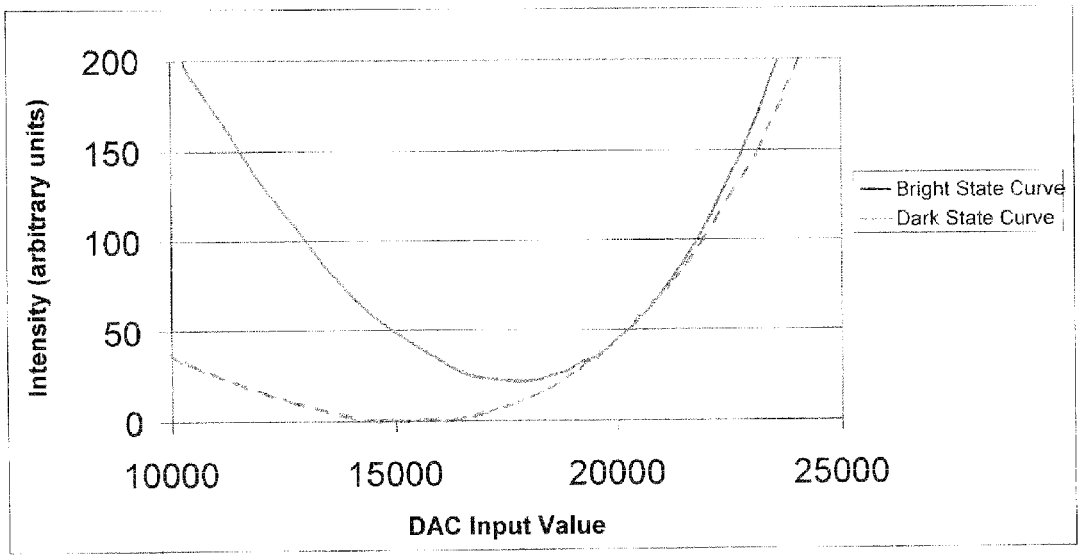
FIG. 8 is a graph depicting a combined normalized dark-state curve with a bright-state curve.

As a result of the above described process for combining the dark-state and bright-state equations, there is a smooth transition between using the dark-state equation and the bright-state equation as shown in FIG. 8. In particular, when looking for an intensity for a DAC input value less than X, the dark-state equation is used and when looking for an intensity for a DAC input value greater than or equal to X, the bright-state equation is used. Thus, it will be appreciated that DAC input values less than X are for a first operating range of a pixel, while DAC input values greater that X are for a second operation range of the pixel.

Figure 9:
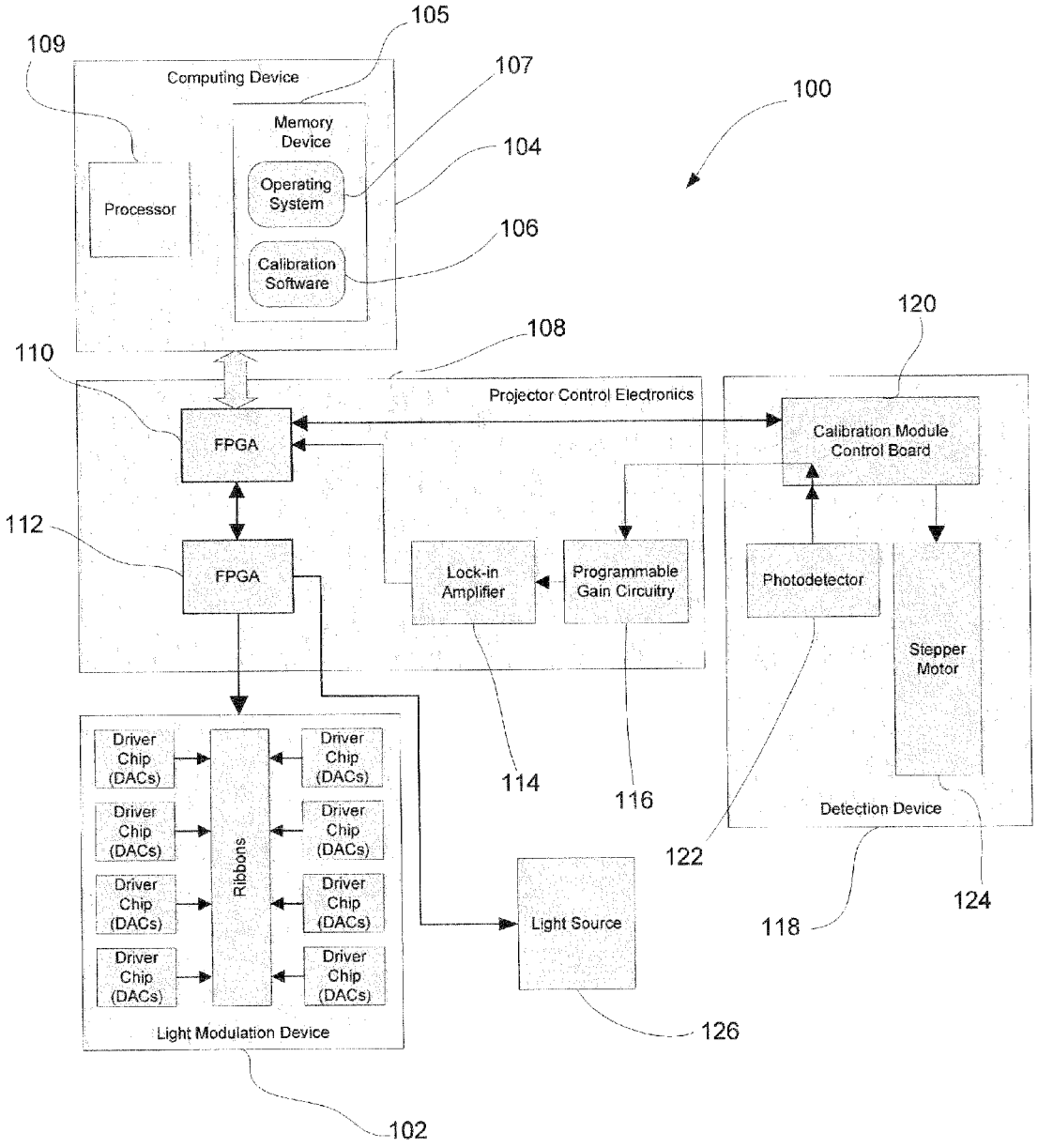
FIG. 9 is a diagram of an exemplary system for calibrating a light modulation device.

Referring now to FIG. 9, there is depicted an exemplary system 100 for calibrating a light modulation device 102. A light modulation device 102 may include a plurality of ribbons, both bias ribbons and active ribbons, which are used to form a plurality of pixels. The system 100 may further include a computing device 104. The computing device 104 may include a computer memory device 105 configured to store computer readable instructions in the form of an operating system 107 and calibration software 106. In an embodiment of the present disclosure, the operating system 107 may be Windows XP®. The processor 109 may be configured to execute the computer readable instructions in the memory device 105, including the operating system 107 and the calibration software 106. The execution of the calibration software 106 by the processor may calibrate the light modulation device 102 using any process described above and that will be more fully described in relation to FIG. 10.

Figure 10:
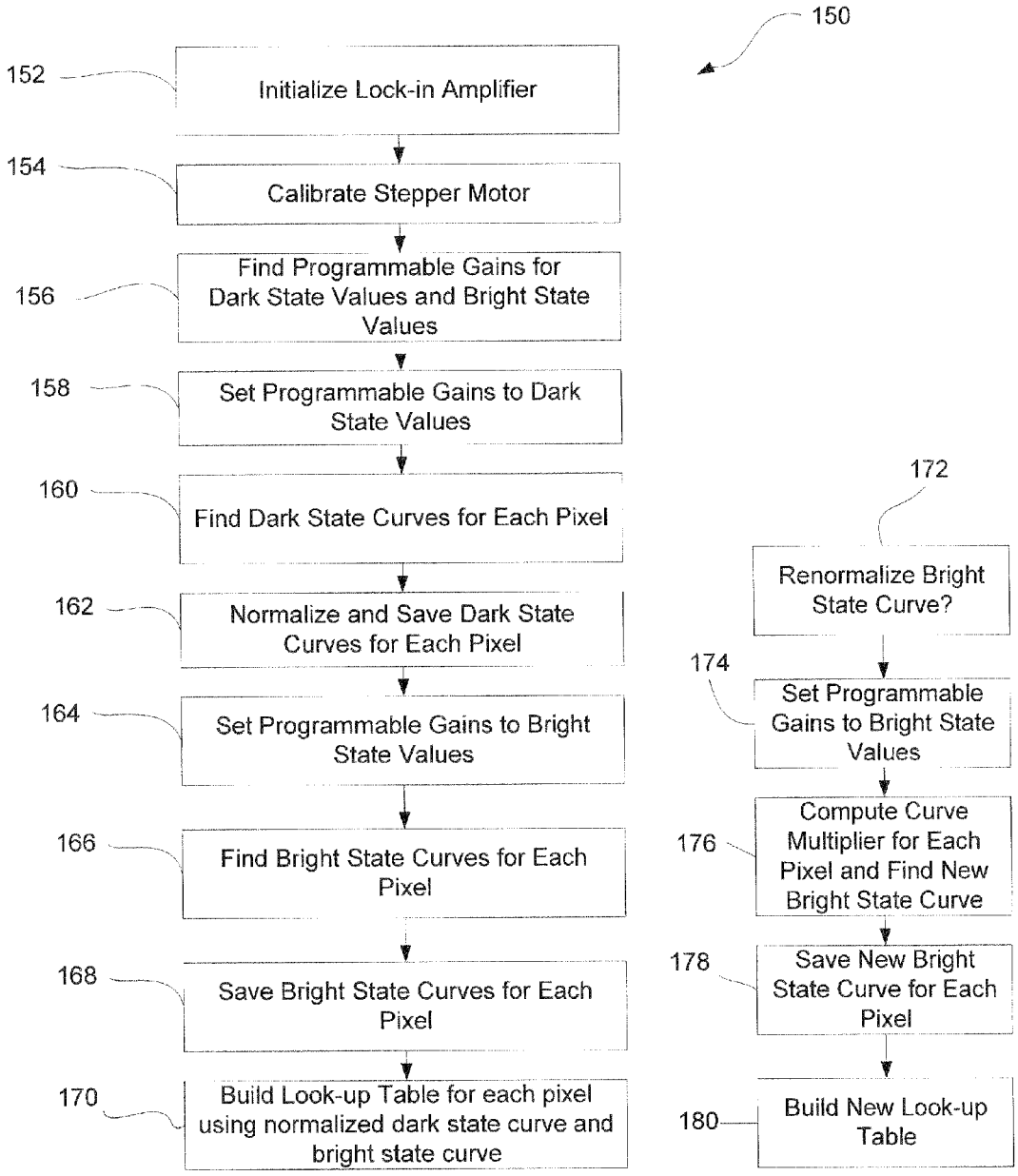
FIG. 10 is a flow chart depicting an exemplary calibration process for a light modulation device.

Referring now primarily to FIG. 10, the computing device 104 may be in communication with projector control electronics 108. The projector control electronics 108 may include a pair of field programmable gate arrays 110 and 112. The projector control electronics 108 may further include a lock-in amplifier 114 and a programmable gain circuitry 116. The projector control electronics 108 may further control a light source 126, such as a laser. The light source 126 may provide incident light onto the light modulation device 102. A detection device 118 may include a control board 120, a photodetector 122, and a stepper motor 124. The control board 120 may receive instructions from gate array 110. The control board 120 may send data collected by the photodetector 122 to the programmable gain circuitry 116.

The light modulation device 102 may include a plurality of ribbons having a first group of ribbons, i.e., bias ribbons, and a second group of ribbons, i.e., active ribbons. The first group of ribbons may be commonly controlled by a single DAC. The second group of ribbons may each be individually addressable and controlled by a single DAC. At least one ribbon from the first group and at least one ribbon from the second group may form a pixel on the light modulation device 102. It will be appreciated that the computing device 104 and the projector control electronics 108 may constitute a control device for positioning the first elongated elements of each of the pixels on the light modulation device 102 to a common biased position and for toggling the second elongated elements of each of the pixels one-by-one at a predetermined frequency such that a light intensity response for each of the pixels may be determined. It will be appreciated that as used herein, the term "light intensity response" may mean any information, mapping or data that allows a display system to determine one or more input values or settings for a pixel from the image source data. The image source data may include, for example, data encoding in a predetermined format for a picture, graphic, or video. The term "light intensity response" may further mean any set of data that includes the intensity output of a pixel based upon one or more predetermined input values or settings for the pixel. In this case, the intensity output may be determined experimentally. The processor 109 may determine the light intensity response for each of the pixels, including a bright state response and a dark state response. The processor 109 may also determine an input value for the active ribbon of each of the plurality of pixels at which the bias ribbon and the active ribbon are substantially planar.

Referring now to FIGS. 9 and 10, a flow diagram 150 is shown for calibrating the pixels of the light modulation device 102 using the system 100. The flow diagram 150 may be implemented by the calibration software 106 in the memory device 105. At step 152, the lock-in amplifier 114 is initialized by shifting the phase of its 10 KHz reference wave to match the phase of the 10 KHz toggling signal coming from the photodetector 122. At step 154, the position of the stepper motor 124 is calibrated to locate any given pixel on the light modulation device 102. At step 156, the programmable gains for the programmable gain circuitry 116 are determined by using a single pixel located in the middle of the light modulation device 102. The programmable gains may include dark state gains and bright state gains. Typically, the dark state gains will be high so as to be able to detect low levels of light, while the bright state gains are low so as not to saturate the lock-in amplifier 114.

At step 158, the programmable gain circuitry 116 is set to the dark state gains. At step 160, the dark state curve or equation for each of the pixels is determined on a pixel-by-pixel basis as described above. At step 162, the dark state curve or equation for each pixel is normalized and stored in computer memory. At step 164, the programmable gain circuitry 116 is set to the bright state gains. At step 166, the bright state curve or equation for each of the pixels is determined on a pixel-by-pixel basis. At step 168, the bright state curve or equation for each pixel is stored in a computer memory. At step 170, a look-up table for each pixel is constructed using the pixel's normalized dark state curve or equation and its corresponding bright state curve or equation. This may take the form of the table disclosed in U.S. Patent Publication No. 2008/0055618 (application Ser. No. 11/514,569), which is now hereby incorporated by reference in its entirety. The processor 109 may be operable to generate the look-up table for each of the pixels from their respective bright state curve or equation and dark state curve or equation.

From time to time, it may be necessary to re-normalize the bright state curve or equation determined at step 166 as shown at step 172. This may be required due to degradations or other changes in the amount of illumination produced by the projection lasers of the projection system. At step 174, the programmable gain circuitry 116 is set to the bright state gains. At step 176, a curve multiplier is determined for each pixel and the bright state curve or equation of each pixel found at step 166 is multiplied by this curve modifier. This may be accomplished by measuring a single intensity and then re-normalizing the previous bright state curve to this new intensity. It will be appreciated that this allows a system to be quickly re-calibrated to account for illumination changes. At step 178 the re-normalized bright state curve or equation is saved for each pixel in a computer memory. At step 180, a new look-up table for each pixel is constructed.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of calibrating a plurality of pixels of a light modulation device, each of said pixels comprising a first elongated element and a second elongated element, comprising:

applying a voltage to the first elongated elements of each of the plurality of pixels such that they are deflected to a common biased position; and determining a light intensity response for each of the plurality of pixels, pixel-by-pixel, using a photodetector while said first elongated elements are held at the common biased position using a processing device.

2. The method of claim 1, wherein said common biased position resides below the second elongated elements in an undeflected state.

3. The method of claim 1, wherein determining a light intensity response for each of the plurality of pixels, pixel-by-pixel, further comprises:

selecting one of the plurality of pixels for calibration;

toggling the second elongated element of the pixel selected for calibration;

capturing light reflected off of the plurality of pixels using the photodetector;

generating a signal using the photodetector based upon the captured light, the signal comprising a first portion corresponding to the pixel selected for calibration and a second portion corresponding to the pixels not selected for calibration;

filtering the signal to thereby remove the second portion of the signal; and using the first portion of the signal to determine a light intensity response for the pixel selected for calibration.

4. The method of claim 3, further comprising toggling the second elongated element of the pixel selected for calibration at a predetermined frequency.

5. The method of claim 1, further comprising determining an input value for the second elongated element of each of the plurality of pixels at which the first elongated element and the second elongated element of that pixel are substantially planar.

6. The method of claim 1, further comprising toggling the second elongated element of each of the plurality of pixels between one of a plurality of discrete positions and a reference position, and measuring a light intensity output for the pixel at each of the plurality of discrete positions.

7. The method of claim 6, further comprising determining from the measured light intensity output, an input value for the second elongated element of each of the plurality of pixels at which the light intensity output is at a minimum.

8. The method of claim 6, further comprising using the measured light intensity output in a polynomial curve fit to thereby determine an input value for the second elongated element of each of the plurality of pixels at which the light intensity output is at a minimum.

9. The method of claim 1, further comprising determining a light intensity response for each of the plurality of pixels in a sequential order.

10. The method of claim 1, further comprising positioning the second elongated elements of a group of uncalibrated pixels to an estimated minimum intensity position while determining the light intensity response of a pixel.

11. The method of claim 1, further comprising toggling the second elongated element of a pixel at a predetermined frequency.

12. The method of claim 1, further comprising determining the light intensity response for each pixel using a lock-in amplifier.

13. The method of claim 1, wherein determining a light intensity response for each of the plurality of pixels, pixel-by-pixel, further comprises determining a first light intensity response for a first operating range of each pixel and a second light intensity response for a second operating range of each pixel.

14. The method of claim 13, further comprising generating a look-up table from the first light intensity response and the second light intensity response for each pixel.

15. The method of claim 13, wherein said second light intensity response is for a state brighter than said first light intensity response.

16. The method of claim 1, further comprising generating a look-up table for each of the plurality of pixels.

17. A system for calibrating a plurality of pixels of a light modulation device, each of said pixels comprising a first elongated element and a second elongated element, said system comprising:

at least one light source;

a photodetector for measuring a light intensity output of each of the plurality of pixels;

a control device for positioning said first elongated elements to a common biased position;

said control device further operable to toggle the second elongated elements of the plurality of pixels, one-by-one, while the first elongated elements are positioned at the common biased position; and a processing device for determining a light intensity response for each the plurality of pixels on a pixel-by-pixel basis.

18. The system of claim 17, wherein said control device is further operable for positioning said photodetector in an optical output path of each of the plurality of pixels.

19. The system of claim 17, further comprising a lock-in amplifier for isolating a light intensity output of a single pixel on the light modulation device.

20. The system of claim 17, wherein said common biased position resides below the second elongated elements of the plurality of pixels in an undeflected state.

21. The system of claim 17, wherein said control device is further operable to toggle each of the second elongated elements at a predetermined frequency.

22. The system of claim 17, wherein said processing device is further operable to determine an input value for the second elongated element of each of the plurality of pixels at which the first elongated element and the second elongated element are substantially planar.

23. The system of claim 17, wherein said light intensity response for each pixel comprises a first light intensity response for a first operating range of the pixel and a second light intensity response for a second operating range of the pixel.

24. The system of claim 23, wherein said second light intensity response is for a state brighter than said first light intensity response.

25. The system of claim 17, wherein said processing device is further operable to generate a look-up table for each of the plurality of pixels.

26. A system for calibrating a plurality of pixels of a light modulation device, each of said pixels comprising a first elongated element and a second elongated element, said system comprising:

means for deflecting a first group of elongated elements to a common biased position; and means for determining a light intensity response for the plurality of pixels on a pixel-by-pixel basis while said first elongated elements are held at the common biased position using a processing device.

27. The system of claim 26, further comprising means for toggling the second elongated elements at a predetermined frequency.

28. The system of claim 26, further comprising means for measuring a light intensity output of each of the plurality of pixels.

29. The system of claim 26, further comprising means for isolating a light intensity output of a single pixel on the light modulation device.

30. The system of claim 26, wherein said light intensity response for each of the plurality of pixels comprises a first light intensity response for a first operating range of the pixel and a second light intensity response for a second operating range of the pixel.

31. The system of claim 30, wherein said second light intensity response is for a state brighter than said first light intensity response.

32. The system of claim 26, further comprising means for generating a look-up table for each of the pixels.

33. The system of claim 26, further comprising means for generating incident light onto the light modulation device.

34. A non-transitory computer readable medium for storing computer instructions that, when executed on a computer, enable a processor-based system to:

deflect a first group of elongated elements on a light modulation device to a common biased position; and determine a light intensity response for the plurality of pixels on a pixel-by-pixel basis while the first elongated elements are held at the common biased position.

* * * * *